US010562324B2

(12) United States Patent
Goto

(10) Patent No.: US 10,562,324 B2
(45) Date of Patent: Feb. 18, 2020

(54) PRINTING APPARATUS AND METHOD OF PRINTING

(71) Applicant: CANON FINETECH NISCA INC., Misato-shi, Saitama (JP)

(72) Inventor: Shin Goto, Matsudo (JP)

(73) Assignee: CANON FINETECH NISCA INC., Misato-shi (JP)

( * ) Notice: Subject to any disclaimer, the term of this patent is extended or adjusted under 35 U.S.C. 154(b) by 0 days.

(21) Appl. No.: 16/006,086

(22) Filed: Jun. 12, 2018

(65) Prior Publication Data

US 2018/0361760 A1 Dec. 20, 2018

(30) Foreign Application Priority Data

Jun. 19, 2017 (JP) ..... 2017-119595
Jun. 1, 2018 (JP) ..... 2018-106414

(51) Int. Cl.
*B41J 11/00* (2006.01)
*B41J 3/407* (2006.01)

(52) U.S. Cl.
CPC ..... *B41J 11/0095* (2013.01); *B41J 3/4075* (2013.01)

(58) Field of Classification Search
CPC ..... B41J 11/0095; B41J 3/4075
See application file for complete search history.

(56) References Cited

U.S. PATENT DOCUMENTS 7,600,866 B2 10/2009 Takeshita et al.
9,639,046 B2 5/2017 Fujikura
2015/0091966 A1* 4/2015 Nagaoka ..... B41J 11/0075 347/16
2016/0129706 A1* 5/2016 Maekawa ..... B41J 2/325 347/16
2017/0087906 A1* 3/2017 Arakane ..... B41J 2/04573

FOREIGN PATENT DOCUMENTS

JP H07-047743 A 2/1995
JP 2006-001679 A 1/2006
JP 2006-306011 A 11/2006
JP 2015-205742 A 11/2015
JP 2015-231885 A 12/2015
JP 2017-035850 A 2/2017
JP 2017-052579 A 3/2017
JP 2017-052618 A 3/2017

OTHER PUBLICATIONS

Japanese Office Action dated Nov. 12, 2019, in related Japanese Patent Application No. 2018-106414 (with English translation).

* cited by examiner

*Primary Examiner* — Jason S Uhlenhake
(74) *Attorney, Agent, or Firm* — Venable LLP

(57) ABSTRACT

A printing apparatus includes an acquiring unit to acquire information on a shape of a label, a printing unit to perform printing on the label, a conveying unit to convey the print medium, and a detecting unit to detect the label. In addition, the detecting unit is movable in a direction intersecting a width direction of the sheet, and a control unit, when the label has a shape including a portion protruding towards a downstream side in a conveyance direction, moves the detecting unit to a region corresponding to a most protruding position of the label on the downstream side in the conveyance direction and stops the detecting unit in the region on the basis of the acquired information, and starts the printing unit to start the printing on the label on the basis of a detection result of the detecting unit that is located in the region.

11 Claims, 15 Drawing Sheets

PRINTING APPARATUS AND METHOD OF PRINTING

BACKGROUND OF THE INVENTION

Field of the Invention

The present invention relates to a printing apparatus and a method of printing.

Description of the Related Art

Shapes and materials of print sheets which are print mediums are various. Normally, a printing apparatus is designed to use a rectangular print medium of a predetermined size, and an operation of the apparatus is also decided by specifying a print medium size. In the case of print mediums other than rectangular print mediums, there are cases in which a head portion of the print medium is unable to be detected, and a print sheet is not aligned with a position of a printed image.

Japanese Patent Laid-Open No. 2015-231885 discloses a technique of moving a sensor for detecting a print medium to a predetermined position, so as to detect a head portion of a rectangular print medium.

However, a configuration of technique disclosed in Japanese Patent Laid-Open No. 2015-231885 is based on the assumption that a shape of a print medium a leading end position (the head portion) which is detected is rectangular. Therefore, in a case where the shape of the print medium is not rectangular, a timing at which the leading end position of the print medium arrives at the predetermined position may be unable to be detected correctly. In that case, there is a problem in that, when an image is formed on the print medium, the leading end position of the print medium is unable to be referred to correctly, and the image is unable to be correctly printed on the print medium.

SUMMARY OF THE INVENTION

An object of the present invention is to provide a printing apparatus and a printing method, which are capable of using various print mediums for printing.

A printing apparatus that prints an image on a print medium, which includes a sheet serving as a base and a label formed on the sheet, said apparatus comprising: an acquiring unit configured to acquire information on a shape of the label; a printing unit configured to perform printing on the label; a conveying unit configured to convey the print medium in a predetermined conveyance direction; a detecting unit configured to detects the label; a moving unit configured to cause the detecting unit to be movable in a direction intersecting the conveyance direction; and a control unit configured to, in a case where the label has a shape including a portion protruding on the downstream side in conveyance direction, move the detecting unit to a region corresponding to a most protruding position of the label on the downstream side in the conveyance direction on the basis of information acquired by the acquiring unit, and starts the printing on the label on the basis of a detection result of the detecting unit.

According to the present invention, it is possible to provide a printing apparatus and a method of detecting a print region, which are capable of using various print mediums for printing.

Further features of the present invention will become apparent from the following description of exemplary embodiments with reference to the attached drawings.

DESCRIPTION OF THE EMBODIMENTS

A printing apparatus of the present invention can accurately recognize, specify, and detect a position of a leading end portion of a print region in a print medium in which the print region is formed. For example, it is possible to accurately recognize a position of a leading end portion of a print region in a print medium having a print region (label) of arbitrary shape on a base (mount). Accordingly, a printing apparatus and a printing method which are capable of performing printing so that misalignment does not occur between a print image and a print region (label) are provided. The printing apparatus of the present invention includes a sensor for specifying the leading end position of the print region. On the basis of image data of a printing target, the sensor specifies the leading end portion position in a direction intersecting a conveyance direction of the print medium in advance and detects the leading end position of the print region. The sensor detects the leading end portion position in the conveyance direction on the basis of a detection signal on which a property of the print medium is reflected, and which is obtained in accordance with an inspection signal. The printing apparatus starts printing in the print region on the basis of information obtained from the detected leading end portion position. Hereinafter, a configuration and an operation of a printing apparatus and a method of print region detection of the present invention will be described in detail with reference to the attached drawings.

First, a print medium serving as a target in a printing apparatus of the present invention will be described. In the printing apparatus of the present invention, a printing operation is performed on a print medium in which a print region is formed. For example, a printing operation is performed on a print medium having a print region which is a label of an arbitrary shape formed on a base of a rectangular shape or a roll paper shape.

Figure 14C:
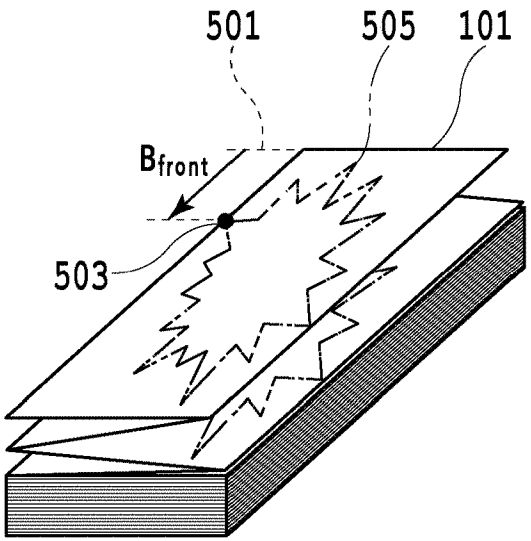
FIGS. 14A to 14C are diagrams illustrating forms of a print medium in a printing apparatus according to the present invention.
Figure 14B:
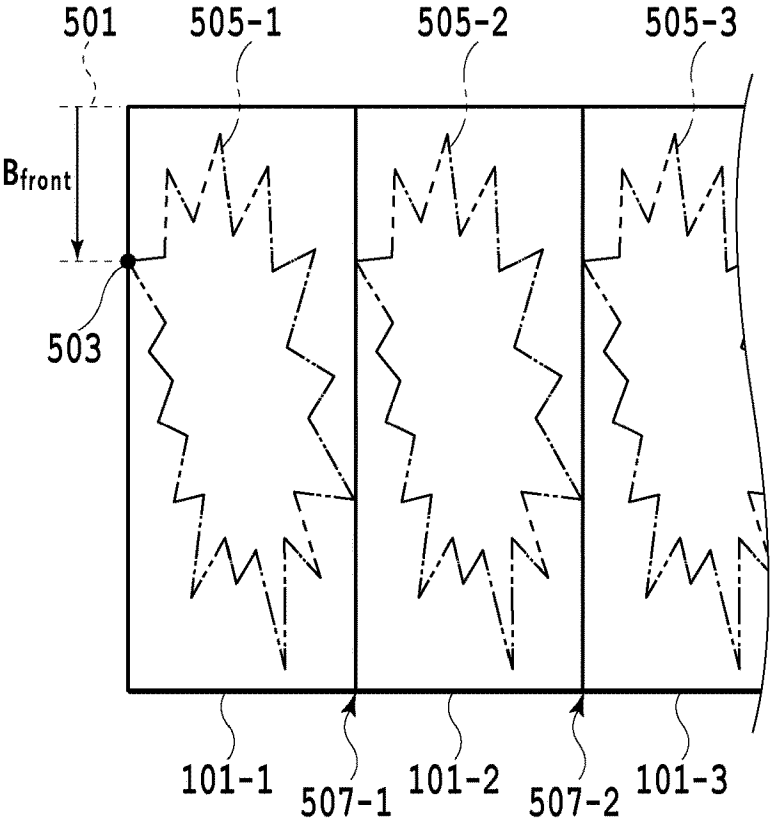
Figure 14A:
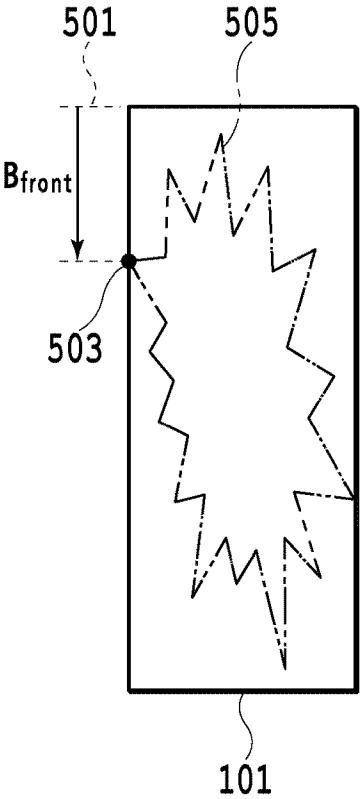

FIGS. 14A to 14C are diagrams illustrating forms of a print medium used in the printing apparatus of the present invention. FIG. 14A illustrates the most basic form of the print medium in which the print region is formed, and the print medium has a label 505 which is a print region on a rectangular base 101. The printing apparatus of the present invention performs an operation of specifying and detecting a label leading end portion 503 which is the most protruding portion thereof on the base 101 before starting the printing operation. A position Bfront of the label leading end portion 503 from a reference end 501 of the base 101 is specified in a direction crossing a conveyance direction. The operation of specifying and detecting the position of the label leading end portion 503 will be described later in detail with reference to FIGS. 4A to 4B, FIG. 5 and FIGS. 8 to 9.

In the following description, the base 101 of the print medium is described as a mount, and the print region is described as the label 505 formed on the mount. Materials of the base and the label in which properties of the materials of the base and the label (for example, transmittance and reflectance of light) are reflected on a level change of a detection signal according to an inspection signal which can be detected by the sensor according to an inspection signal, in the printing apparatus of the present invention, may be used.

FIGS. 14B and 14C are diagrams illustrating forms of the print medium used in the printing apparatus of the present invention. A print medium shown in FIG. 14B is a print medium in which a plurality of rectangular bases 101-1, 101-2, . . . , each of which is shown in FIG. 14A, are arranged in series and can be stored in, for example, a roll form. Each of labels 505-1, 505-2 which is print region is formed on a respective base. For example, perforation-like cutting portions 507-1, 507-2 may be formed between the base 101-1 and the base 101-2 and between the base 101-2 and the base 101-3.

A print medium shown in FIG. 14C is a Z-hold type label sheet bent at the boundary of the base 101 in which a plurality of bases 101 having a rectangular shape similar to that shown in FIG. 14A are arranged in a row and alternately foldable in a Z shape. The label 505 which is a print region is formed on each of a plurality of bases 101 which are connected to each other. In the case of the print mediums of both shown in FIGS. 14B and 14C, the position Bfront of the label leading end portion 503 with respect to the reference end 501 of the base 101 is specified by a sensor to be described later, similarly to the configuration shown in FIG. 14A.

For the sake of simplicity of descriptions, detailed descriptions of the following embodiment and the like will be described using a roll-like label sheet illustrated in FIG. 14B that can be suitably used in the printing apparatus of the present invention.

[Configuration of Printing Apparatus]

Figure 1:
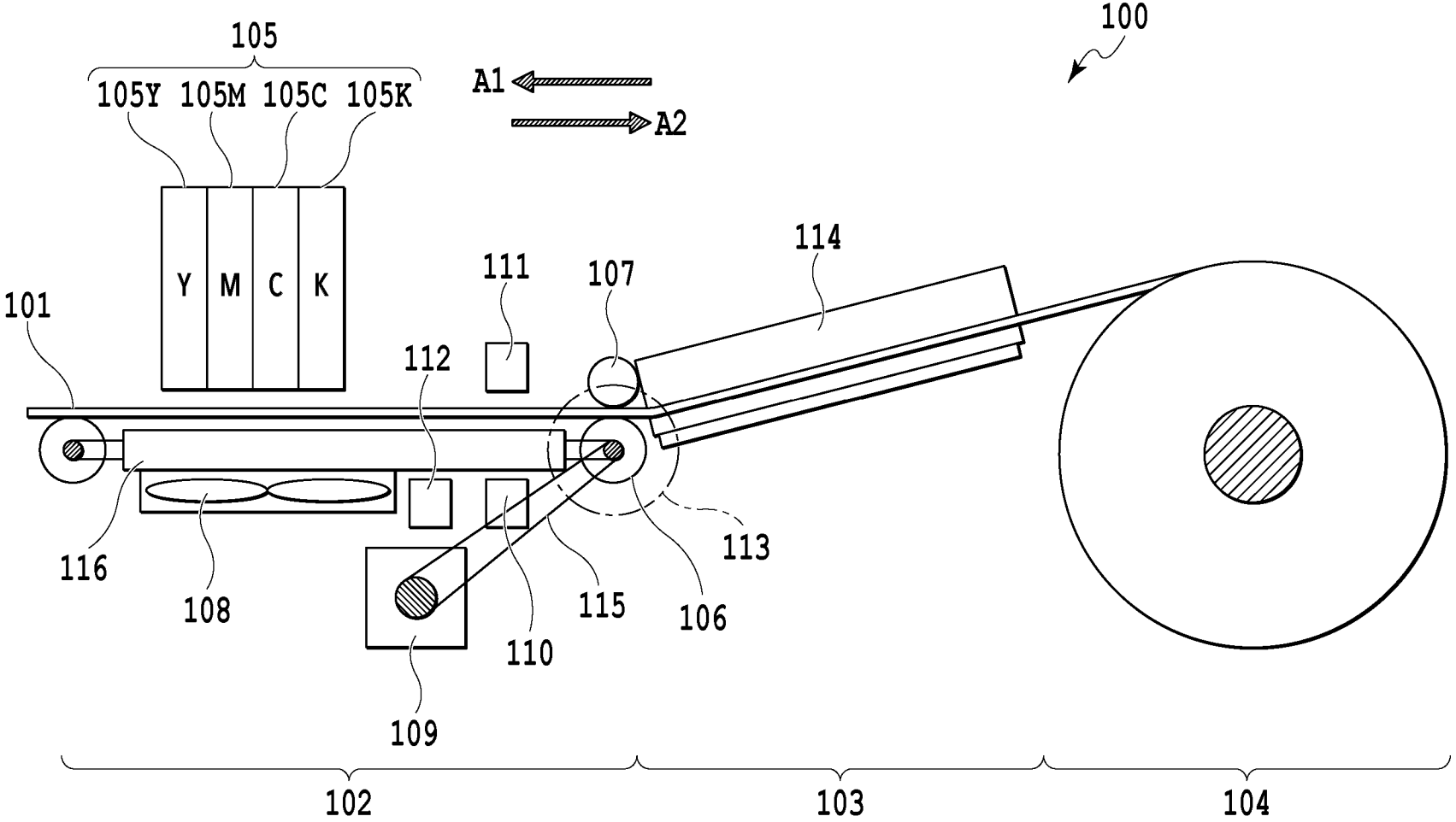
FIG. 1 is a diagram illustrating an overview of a configuration of a printing apparatus according to the present invention.

FIG. 1 is a diagram illustrating an overview of a configuration of a printing apparatus according to the present invention. FIG. 1 illustrates a cross section obtained by taking a center of a printing apparatus 100 along conveyance directions (A1 and A2) of a rectangular sheet or a roll-like sheet. The printing apparatus 100 of the present invention is, for example, an ink jet printing apparatus, and includes a light emitting unit 110 and a light receiving unit 111 which will be described as a sensor 200 later and are used for detecting a base 101 and a leading end portion of a label 505. The printing apparatus 100 roughly includes a conveying unit 102, a regulating unit 103, and a sheet feeding unit 104. The base 101 is fed from the sheet feeding unit 104 and fed to the conveying unit 102 via the regulating unit 103. The regulating unit 103 detects a length of the print medium in a width direction while regulating movement of the base 101 in a direction orthogonal to the conveyance directions (A1 and A2).

In the following description, the direction orthogonal to the conveyance direction of the base 101 will be referred to as a direction intersecting the conveyance direction. Commonly, the conveyance direction of the print medium in the printing apparatus is parallel to one side of a rectangular print medium (print sheet), for example, a print head moves or is arranged in a direction of another side orthogonal to the print medium, and image forming is performed. However, it is also possible to arrange/configure a print head and an associated mechanism to be slightly inclined from the direction orthogonal to the conveyance direction. In the following description, the direction intersecting with the conveyance direction includes not only a direction strictly orthogonal to the conveyance direction but also a direction approximately orthogonal to the conveyance direction.

The base 101 is pinched between a conveying roller 106 and a pinch roller 107 so that the base 101 can be conveyed in a direction of arrow A1 and a direction of A 2 opposite thereto. Hereinafter, the direction of arrow A1 is referred to as a "conveyance direction," and the direction of arrow A2 is referred to as a "backward direction." The base 101 to be conveyed is received by a platen 116, sucked by a suction fan 108 from a suction port installed in an upper surface of the platen 116, and then conveyed. A head unit including a print head 105 that ejects ink droplets and prints an image on the base 101 is arranged above the platen 116. In the printing apparatus 100, the print head 105 includes print heads 105Y, 105M, 105C, and 105K which eject yellow (Y) ink, magenta (M) ink, cyan (C) ink, and black (K) ink respectively. A plurality of nozzles capable of ejecting ink are formed in each of the print heads and form a nozzle array extending in the direction intersecting the conveyance direction. Each of the nozzles is configured to eject ink using an ejection energy generating element such as the electrothermal converting element (heater) or a piezo element. In a case where an electrothermal converting element is used, it is possible to foam ink by heat generation thereof and eject ink from an ejection opening of a nozzle leading end using foaming energy.

A reflective TOF sensor 112 which can detect a top of form (TOF) mark attached to the base 101 or detect an end portion of the print medium may be installed on an upstream side of the print head 105 in the conveyance direction. Further, the light emitting unit 110 of the transmissive TOF sensor unit and the light receiving unit 111 of the transmissive TOF sensor unit which specify and detect the label leading end portion 503 of the base 101 according to the present invention are installed on the upstream side. The conveying roller 106 that provides conveying force to the base 101 and the pinch roller 107 opposite thereto are installed on the upstream side further than the light emitting unit 110 and the light receiving unit 111. Further, a regulating unit 103 and a reference wall 114 which regulate the position of the base 101 in the direction intersecting the conveyance direction are installed on the upstream side further than the pinch roller 107 in the conveyance direction. A movable guide (not illustrated) is installed at a position opposite to the reference wall 114 (front side in FIG. 1), and the end portion of the base 101 in the conveyance direction is regulated by the movable guide to abut on the reference wall 114. Accordingly, the position of the base 101 is regulated in the direction intersecting the conveyance direction.

The conveying roller 106 is driven forward or backward by a conveying roller driving motor 109 via a drive transmission belt 115. The conveying roller 106 causes the base 101 to move in the conveyance direction of arrow A1 or in the backward direction of arrow A2. A code wheel 113 is attached to the conveying roller 106. An encoder sensor including the code wheel 113 manages a conveyance speed of the base 101 and a driving frequency (an ink ejection frequency) of the print head 105. Next, a configuration of the sensor for specifying and detecting the leading end portion position of the print medium having one or more print regions on the base in the printing apparatus of the present invention will be described.

[Configuration of Sensor]

Figure 2:
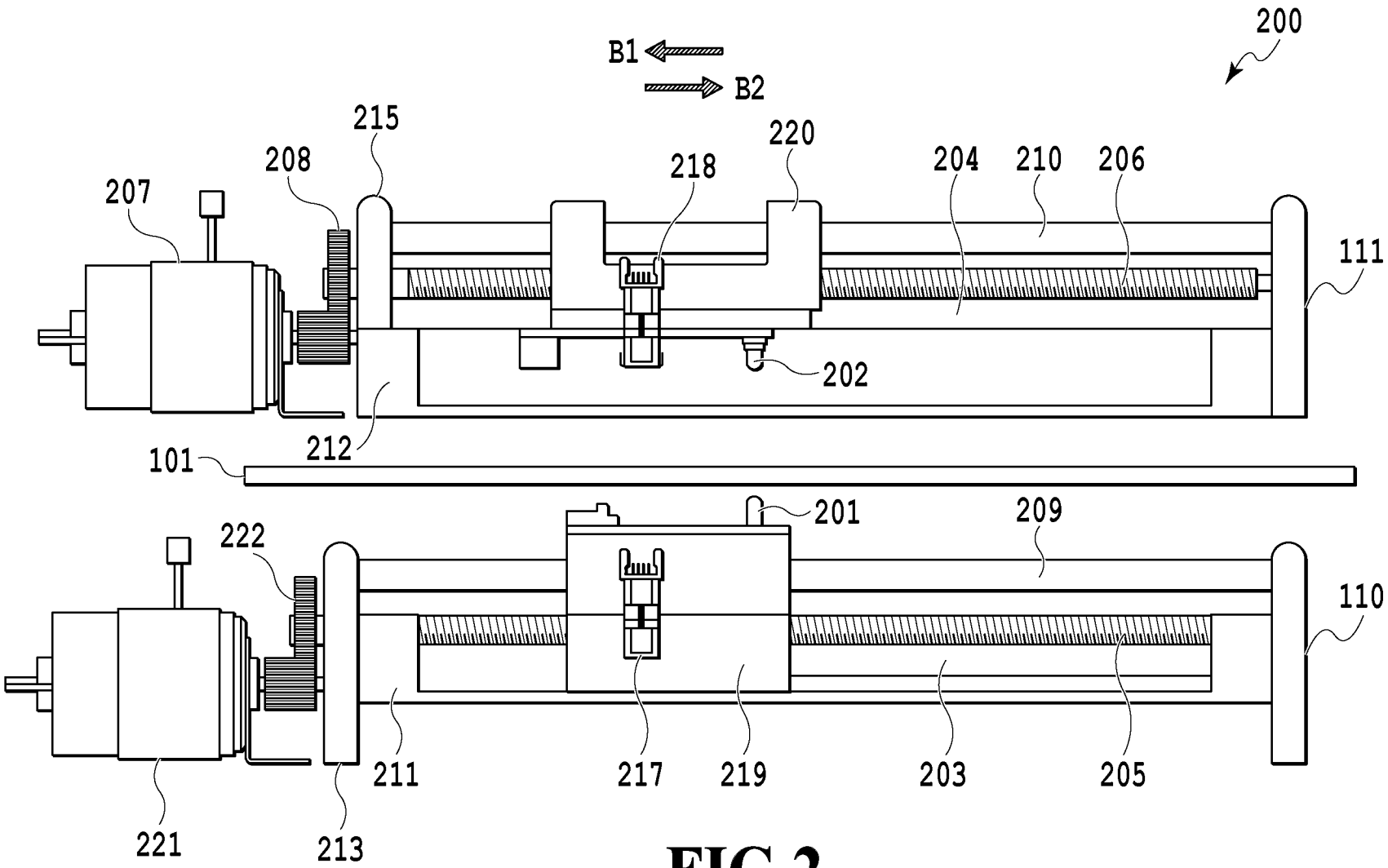
FIG. 2 is a diagram for describing a sensor that specifies and detects a leading end portion of a print medium.

FIG. 2 is a diagram for describing a configuration of the sensor that specifies and detects the position of the label leading end portion 503 of the label 505 which is a print region. Hereinafter, an example of a configuration using a transmissive TOF sensor suitable as the sensor 200 will be described, but the sensor 200 is not limited to a TOF sensor as will be described later in detail. A common transmissive optical sensor can be used, and various variations using a detection signal other than light can be made. The sensor 200 includes the light emitting unit 110 of the transmissive TOF sensor unit and the light receiving unit 111 of the transmissive TOF sensor unit. The light emitting unit 110 and the light receiving unit 111 are arranged in the vertical direction with the base 101 interposed therebetween. In the light emitting unit 110, a transmissive TOF sensor light emitting element 201 is mounted on a light emitting side carriage 219. Similarly, in the light receiving unit 111, a light receiving element 202 of the transmissive TOF sensor is mounted on a light receiving side carriage 220. A scale sensor 217 is attached to the light emitting side carriage 219, and a scale sensor 218 is attached to the light receiving side carriage 220. A linear scale 203 is detected by the scale sensor 217, and thus it is possible to manage a movement amount of the light emitting side carriage 219 in directions B1 and B2 intersecting the conveyance direction. Similarly, a linear scale 204 is detected by the scale sensor 218, and thus it is possible to manage a movement amount of the light receiving side carriage 220 in the direction intersecting the conveyance direction.

The linear scale 203 is mounted on a fixed stand 211, and the linear scale 204 is mounted on a fixed stand 212. The light emitting side carriage 219 is supported by a carriage support shaft 209 to be movable in the directions of B1 and B2 intersecting the conveyance direction. Similarly, the light receiving side carriage 220 is supported by a carriage support shaft 210 to be movable in the directions of B1 and B2. A linear drive shaft 205 passes through the light emitting side carriage 219, and a drive transmission gear 222 and a driving motor 221 are connected to the linear drive shaft 205. The light emitting side carriage 219 transmits drive from the driving motor 221 to the linear drive shaft 205, so that the linear drive shaft 205 rotates. Since a posture of the light emitting side carriage 219 is fixed by the carriage support shaft 209, the light emitting side carriage 219 can move in the direction of B1 or B2 without rotating. Similarly, a linear drive shaft 206 passes through the light receiving side carriage 220, and a drive transmission gear 208 is connected to the linear drive shaft 206. The drive transmission gear 208 transmits drive from a driving motor 207 to the linear drive shaft 206, so that the linear drive shaft 206 rotates. Similarly to the light emitting side carriage 219, the light receiving side carriage 220 supported by the carriage support shaft 210 can move in the direction of B1 or B2 intersecting the conveyance direction.

The light emitting element 201 of the light emitting unit 110 outputs light. When the light emitting unit 110 and the light receiving unit 111 are positioned to face each other, the light from the light emitting element 201 is received by the light receiving element 202 of the light receiving unit 111. If the base 101 is positioned between the light emitting element 201 and the light receiving element 202, the light attenuates depending on transmittance of the print medium, and the print medium can be detected on the basis of the light receiving level change of the light receiving element 202. The light emitting element 201 functions as a signal output unit that outputs a signal for detecting the leading end portion position, and the light output from the light emitting element 201 functions as an inspection signal to be output to the print medium. Further, the light receiving element 202 functions as a signal acquiring unit that acquires (receives) a signal for detecting the position of the label leading end portion 503, and the light received by the light receiving element 202 functions as a detection signal in which the property (transmittance) of the print medium is reflected in accordance with the inspection signal. In other words, the light emitting element 201 of the light emitting unit 110 operates to output the inspection signal to the print medium. Further, the light receiving element 202 of the light receiving unit 111 operates to acquire a detection signal having a variable level in which a difference in the physical property of the print medium is reflected in accordance with the inspection signal.

[Electrical Configuration of Printing Apparatus]

Figure 3:
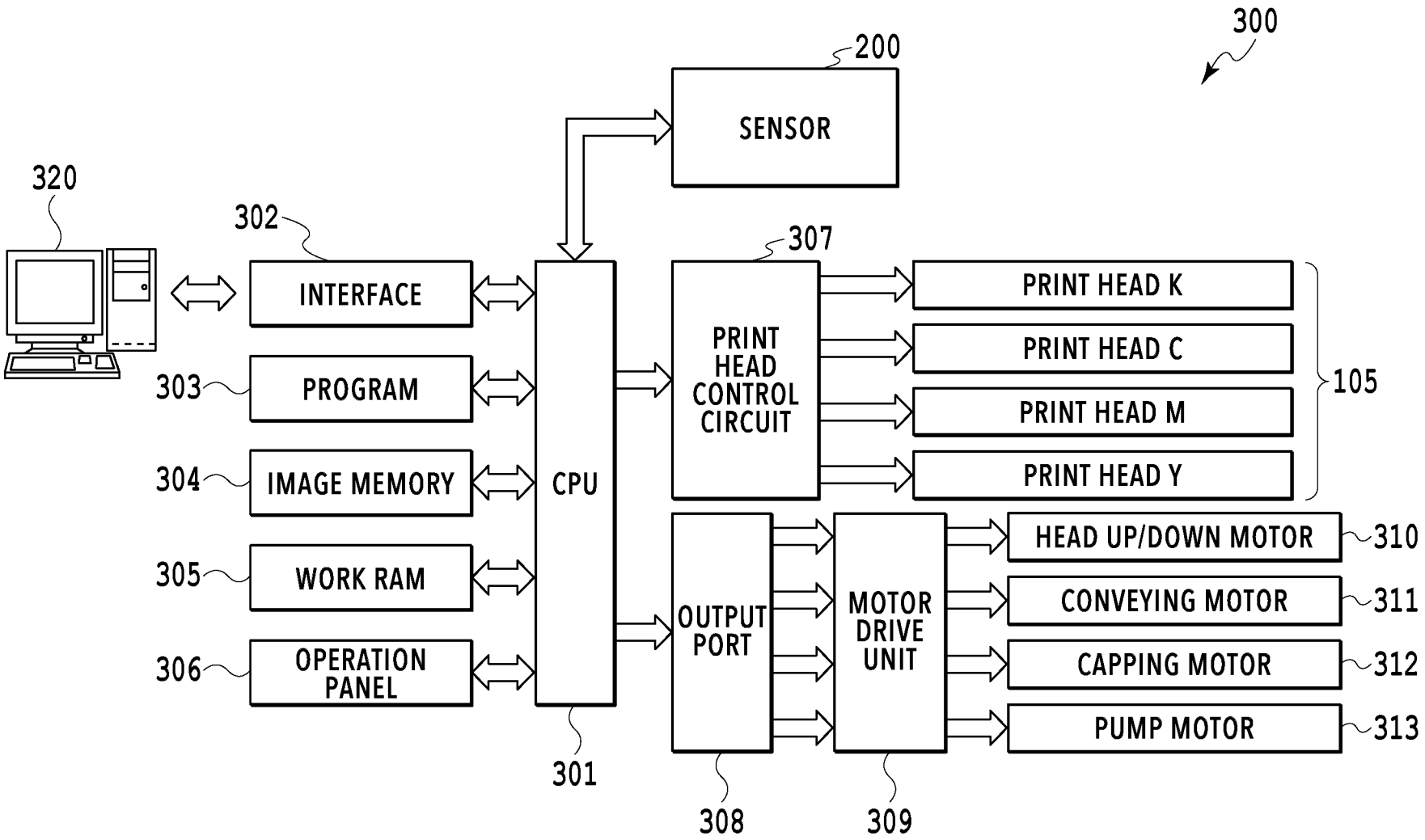
FIG. 3 is a block diagram illustrating an electrical system of a printing apparatus according to the present invention.

FIG. 3 is a block diagram illustrating an electrical system of the printing apparatus according to the present invention. A printing apparatus 300 is configured to be able to perform communication with a host PC 320 via a wired or wireless communication line. Printing data or a command transmitted from the host PC 320 is received by a CPU 301 via an interface controller 302. The CPU 301 is an operation processing device that controls reception of printing data and a printing operation of a printer, handling of a print medium, and the like in general.

The printing apparatus 100 of the present invention illustrated in FIG. 1 is intended for a print medium including a print region. For example, a print medium (roll mediums) on which a plurality of label 505 serving as the print region are attached onto the base wound in a roll form is used. After analyzing the received command, the CPU 301 decompresses image data of respective color components of the printing data as binary bitmap image onto an image memory 304 and performs rendering. As an operation process before print, the CPU 301 drives a drive capping motor 312 and head up/down motor 310 via an output port 308 and a motor drive unit 309, and causes print heads K, C, M, and Y to be separated from a capping mechanism and moved to a printing position. Therefore, the CPU 301 functions as a control unit until printed of an image on the print medium starts or ends.

Then, the CPU 301 drives a roll motor (not illustrated) that feeds the base 101 wound in a roll form and the motor drive unit 309, a conveying motor 311 that conveys the base 101 at a constant speed, and the like via the output port 308 so that the base 101 and the label 505 on the base 101 are conveyed to the printing position. In order to decide a timing (printing timing) at which ink starts to be ejected onto label 505 conveyed at a constant speed, the label 505 is detected through the sensor 200 which detects the label 505. Thereafter, the CPU 301 sequentially reads print data of corresponding color from the image memory in synchronization with the conveyance of the label 505, and transfers the read data to the respective print heads K, C, M, and Y via a print head control circuit. The operation of the CPU 301 is executed on the basis of a processing program stored in a program ROM 303. Processing programs and a table corresponding to a control flow are stored in the program ROM 303. Further, a work RAM 305 is used as a work memory. At the time of a cleaning or recovery operations of each of the print heads K, C, M, Y, the CPU 301 drives a pump motor 313 via the output port 308 and the motor drive unit 309 and controls pressurization, suction, and the like of ink.

The sensor 200 that detects the label 505 will be now described. As will be described later, the sensor 200 performs an operation of detecting the position of the label leading end portion 503 in cooperation with the CPU 301. An electrical system diagram of FIG. 3 illustrates an exemplary configuration of the print apparatus, and the present invention is not limited to this example. For example, CPUs may be distributed in a plurality of places, and a plurality of CPUs operate in cooperation to control the printing apparatus. Further, the sensor 200 may include a CPU for executing at least a part of processing procedures to be described in FIGS. 8 and 9. Therefore, the sensor 200 can also be configured as a detection module which operates in cooperation with the printing apparatus 300 and specifies and detects the position of the leading end portion of the print medium in which the print region is formed.

[Detection of Leading End Portion of Print Region]

Next, a leading end portion detection operation for the print medium in which print region is formed will be described in detail. The leading end portion detection operation is performed for forming an image in a predetermined print region of the print medium without a difference in position between the predetermined print region and formed image. As the print medium, a print medium including a print region (label) having any shape other than a rectangular shape formed on the base is taken for example. The leading end portion of the print region (label) in the print medium refers to a portion that first arrives at an area in which printing is performed by the print head 105 when the print medium is conveyed. The leading end portion is a portion for which printing is first performed by the print head 105.

In the printing apparatus of the present invention, the detection of the position of the leading end portion of the print region is performed on the basis of positional information on the leading end portion of image data as a print target. In the present embodiment, the detection of the position of the leading end portion of the print region is performed through a cooperation of the sensor 200 (the light emitting unit 110 and the light receiving unit 111 of the transmissive TOF sensor) with the CPU 301, which were described in reference to FIGS. 1 and 2. The print medium used in the printing apparatus of the present invention is a print medium including the label 505 serving as the print region on the rectangular base 101 as illustrated in FIGS. 14A to 14C. For the sake of simplicity of the description, the roll-like label sheet illustrated in FIG. 14B which can be suitably used in the printing apparatus of the present invention will be described below as an example.

Figure 4B:
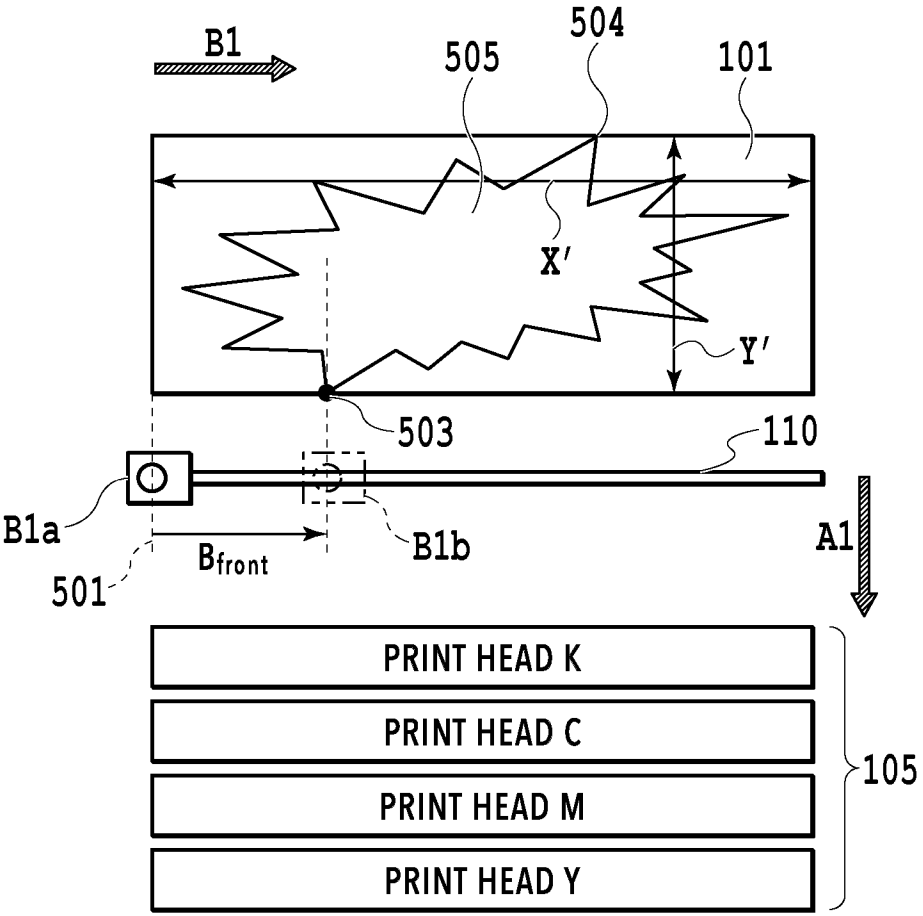
FIGS. 4A and 4B are diagrams for conceptually describing a leading end portion detection operation of a sensor.
Figure 4A:
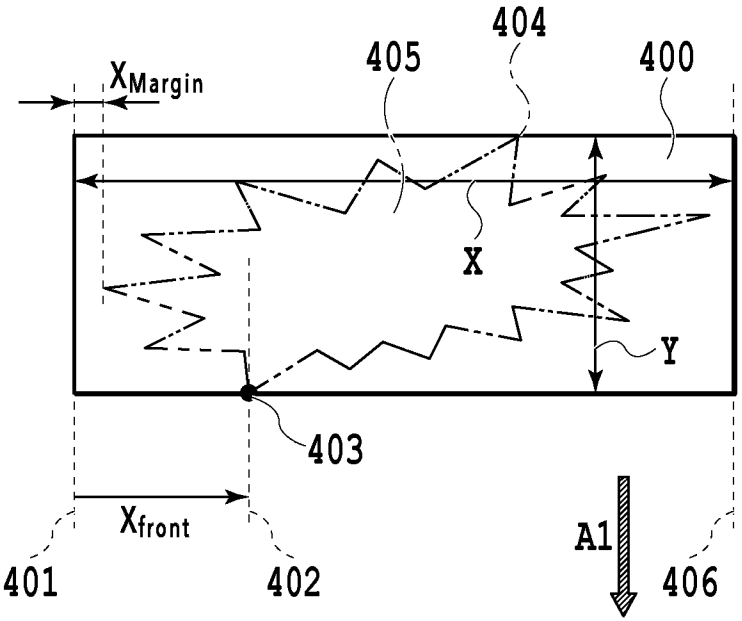

FIGS. 4A and 4B are diagrams illustrating a concept of the leading end portion which is specified and detected by the sensor of the printing apparatus according to the present invention in both a bitmap image on the memory space and a real space of the printing apparatus. A relation between the position of the leading end portion on the bitmap image and the position of the leading end portion of the label is described together with operations of respective units of the transmissive TOF sensor.

Image data is decompressed onto the memory space as bitmap image by driver software. FIG. 4A illustrates the bitmap image decompressed onto the memory space. On the other hand, FIG. 4B illustrates the print region, for example, the label of the print medium in the real space of the printing apparatus. The bitmap image in FIG. 4A is an image to be printed on the print region in FIG. 4B.

When a bitmap image 405 corresponding to a print region of an arbitrary shape is generated on the memory space, firstly a size Y in a direction which is parallel to a conveyance direction A1 and corresponds to a length of the print medium and a size X in a width direction of the print medium orthogonal to the conveyance direction A1 are defined. In the description of FIG. 4A and FIG. 4B, for example, since a rectangular mount is explained as the base 101, an expression of an orthogonal direction is used. However, as described above, the width direction of the print medium orthogonal to the conveyance direction A1 includes the direction intersecting the conveyance direction.

It should be noted that the bitmap image 405 of an exploding shape shown in FIG. 4A corresponds to a print region of an exploding shape, that is, a region having contour of the label 505 in FIG. 4B. In the printing apparatus of the present invention, the bitmap image 405 on the memory space is made to correspond to the contour of the label 505, and an image leading end portion 403 is made correspond to the label leading end portion 503 of the contour region of the actual label 505 in the real space of the printing apparatus. Thus, the label leading end portion 503 of the label on the print medium can be detected on the basis of information indicating the position of the image leading end portion 403 of the image data which is the print target.

The size Y in a direction which is parallel to the conveyance direction A1 and corresponds to the length direction of the print medium, on the memory space of FIG. 4A corresponds to a length Y' from the label leading end portion 503 to a terminal position 504, of the contour of the label 505 in the conveyance direction A1, in the real space in FIG. 4B. Also, the size X corresponding to the width direction B1 of the print medium, which is orthogonal to the conveyance direction A1 in the bitmap image 405 in FIG. 4A, corresponds to a width X' of the base 101 on which the label 505 is arranged in the real space of FIG. 4B. An image actually printed on the label 505 coincides with a range of the bitmap image 405 of the exploding shape or is located on the inside further than the label 505. It is because a peripheral portion of the physical print medium has a certain degree of margin portion in which printing is not generally performed in consideration of printing misalignment. As described above, the bitmap image 405 on the memory space corresponds to the contour region of the label 505, that is, the print region in the actual print medium.

Referring again to FIG. 4A, on the memory space, a reference line 401 at a left end of an image 400 in the width direction B1 orthogonal to the conveyance direction A1 is defined as one side end portion of the image on a reference side. A line 406 which is apart from the reference line 401 by X in the width direction B1 orthogonal to the conveyance direction A1 is defined as the other side end portion of the image 400. In the image 400 on the memory space, a position which is on a line extended in the width direction B1 orthogonal to the conveyance direction A1 and at which the forefront of the bitmap image 405 of the exploding shape starts to be printed is defined as the image leading end portion 403 of the bitmap image 405. A point 404 which is apart from the image leading end portion 403 in a direction opposite to the conveyance direction by Y and is at the last position of the bitmap image 405 is defined as a terminal portion of the image data. A line parallel to the reference line 401 and passing through the image leading end portion 403 is defined as a line 402, and a distance Xfront from the reference line 401 to the line 402 is calculated. Then, information (Xfront) indicating the position of the image leading end portion 403 of the bitmap image 405 of the exploding shape is also transmitted from the host PC 320 to the printing apparatus 300 together with the image data (bitmap image 405 and image 400).

In FIG. 4A, the distance XMargin from the reference line 401 to the bitmap image 405 in the orthogonal width direction B1 is also drawn. Commonly, since the label 505 on the base 101 is arranged inside the base, a margin corresponding to XMargin exists between the label 505 and reference side end portion of the base 101. XMargin may be 0. The leading end portion of the bitmap image 405 in the printing apparatus of the present invention is the image leading end portion 403 in the conveyance direction A1 of the print medium.

FIG. 4B is a diagram schematically illustrating an operation of the printing apparatus which has received image data transmitted from the host PC 320 and the information (Xfront) indicating the position of the image leading end portion 403. In FIG. 4B, the base 101 and the label 505 formed thereon of the print medium are illustrated in the real space of the printing apparatus. The printing apparatus that has received the image data first causes the reference line 401 to coincide with the reference end 501 of the base 101. As already described above, the position in the direction B1 of the base 101 of the print medium is regulated by the reference wall 114, and a regulation position by the reference wall 114 can be defined as the reference end 501.

In the printing apparatus of the present invention, CPU 301 specifies that the sensor 200 (the light emitting unit 110 and the light receiving unit 111) is located in the reference end 501 of the base 101 (an initial position B1*a* to be described later). Then, CPU 301 moves the sensor 200 to the position for detection of the label leading end portion 503 on the label 505 on the basis of the information (Xfront) indicating the position of the image leading end portion 403 of the image data received from the host PC 320. In other words, CPU 301 causes the light emitting element 201 of the sensor 200 to be moved by Bfront in the direction of B1 from the initial position B1*a* to be described later, specifies a position B1*b* of the label leading end portion 503, and stops it at the position B1*b*.

In FIG. 4B, in addition to the base of the print medium and the label formed thereon in the real space, the light emitting element of the light emitting unit 110 in the sensor 200 is schematically shown on the downstream side of the conveyance direction A1. Further, the print head 105 is shown on the downstream side, and FIG. 4B corresponds to a top view of a plane including the print medium of the printing apparatus 100 illustrated in the cross-sectional view of FIG. 1. A state shown in FIG. 4B is a state in which the base 101 is at a retreat position as will be described later with reference to FIGS. 8 and 9.

In FIG. 4B, the initial position B1*a* is a reference position at which the light emitting element 201 of the light emitting unit 110 of the transmissive TOF sensor is positioned at the reference end 501 of the base 101. In a case where the shape of the base 101 is a rectangular shape or a roll shape, the end portion of the base 101 is defined as the initial position B1*a*, and the label leading end portion 503 on the base 101 is specified using B1*a* as a starting point.

In other words, the length Bfront from the reference end 501 of the base 101 to the label leading end portion 503 is decided on the basis of the information (Xfront) indicating the position of the image leading end portion 403 of the image data received from the host PC 320. Thus, it is possible to specify the position B1*b* in the direction B1 and position the light emitting element 201 of light emitting unit 110 of transmissive TOF sensor at the position B1*b* of label leading end portion 503. Here, the light emitting side carriage 219 is actually moved in the light emitting unit 110, but for the sake of simplicity of the description, the light emitting element 201 is described as being moved.

A case in which a resolution of the bitmap image is 1200 dots per inch (dpi), and a resolution of the linear scale 203 of the light emitting unit 110 is 360 dpi is taken for example. For example, the image leading end portion 403 of the image data on the memory space is positioned to be away from the image reference line 401 by 945 dots (20 mm). In this case, on the linear scale 203, a position at which 284 pulses are detected from the initial position B1*a* as the number of output pulses from the scale sensor 217 is defined as the position B1*b* of the label leading end portion 503 of the label 505. At this time, if the width of the print medium detected by the regulating unit 103 does not coincide with the length X of the image data received from the host PC 320 in the width direction, it is possible to stop the printing start. Accordingly, it is possible to prevent the inside of the printing apparatus from becoming dirty due to extrusion of printing or the like. Next, a more specific operation of the sensor 200 that specifies and detects the position of the label leading end portion of the label at which the print region is formed in the printing apparatus of the present invention will be described.

Figure 5:
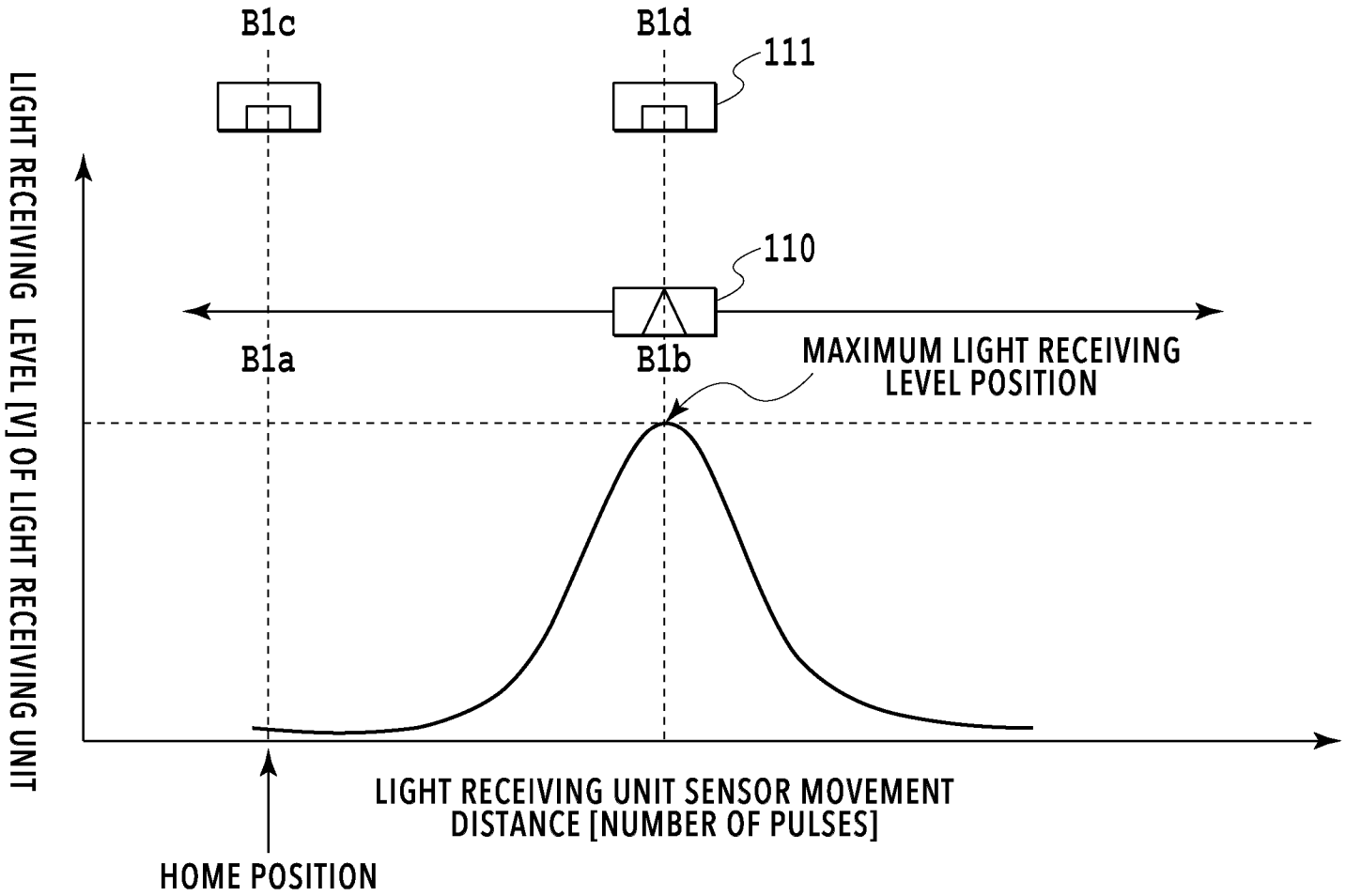
FIG. 5 is a diagram for describing operations of a light emitting unit and a light receiving unit of a sensor.

FIG. 5 is a diagram schematically illustrating a position relation between the light emitting unit and the light receiving unit in the sensor 200 of the printing apparatus of the present invention and transition of the light receiving level of the light receiving element in the light receiving unit. Further, FIG. 5 illustrates a state after the light emitting element 201 of the light emitting unit 110 is moved from B1*a* to B1*b* in the direction B1 orthogonal to the conveyance direction through the method briefly described with reference to FIGS. 4A and 4B. After the light emitting element 201 is moved, the light receiving unit 111 of the sensor 200 is moved. On the basis of the information (Xfront) indicating the position of the image leading end portion 403 of the image data transmitted from the host PC 320, the position of the image leading end portion 403 of the image data is calculated using the basis of the reference line 401 as the starting point. Here, it is assumed that the resolution of the bitmap image is 1200 dpi, and the resolution of the linear scale 204 in the light receiving unit 111 is 360 dpi. The image leading end portion 403 of the image data is positioned to be away from the reference line 401 by 945 dots (20 mm) on the bitmap image. Similarly to the case of the light emitting unit 110, in the linear scale 204, a position at which 284 pulses are detected from an initial position B1*c* as the number of output pulses of the scale sensor 218 is defined as B1*d*. Since the end portion 501 of the base 101 coincide between the light emitting unit 110 and the light receiving unit 111, the initial position B1*c* of the light receiving element 202 of the light receiving unit 111 is a point directly above the initial position B1*a* of the light emitting element 201 of the light emitting unit 110 in a vertical direction. Similarly, the position B1*d* after the light receiving element 202 of the light receiving unit 111 is moved is a point directly above the position B1*b*, in the vertical direction, corresponding to the label leading end portion 503 specified as the light emitting element 201 of the light emitting unit 110 is moved in the direction B1 orthogonal to the conveyance direction.

In the operation of the sensor 200 described above, the light emitting element 201 of the light emitting unit 110 and the light receiving element 202 of the light receiving unit 111 are independently moved in the direction B1 orthogonal to the conveyance direction in accordance with the image leading end portion 403 of the image data. As another operation of the light receiving unit 111, the light receiving element 202 of the light receiving unit 111 may be moved in accordance with the position of the light emitting element 201 of the light emitting unit 110. As illustrated in FIGS. 4A and 4B, the light emitting element 201 of the light emitting unit 110 is first moved to the position of B1*b*, and then, the light receiving element 202 of the light receiving unit 111 is moved in the direction B1 orthogonal to the conveyance direction A1 without using the information indicating the position of the image leading end portion 403 of the image data. At this time, the light receiving element 202 of the light receiving unit 111 receives, for example, the output light from the light emitting element 201 of the light emitting unit 110 and is moved while detecting the light receiving level. As the light receiving element 202 is moved in the direction of B1, the light receiving level of the output light (the inspection signal) from the light emitting element 201 of the light emitting unit 110 detected by the light receiving element 202 transitions as illustrated in a graph of FIG. 5. As illustrated in FIG. 5, when the light receiving level detected by the light receiving element 202 becomes maximum, the light receiving element 202 is positioned directly above the light emitting element 201 of the light emitting unit 110 in the vertical direction. Although the information indicating the position of the image leading end portion 403 of the image data is not received from the driver side, it is possible to move the light receiving unit 111 in the direction B1 orthogonal to the conveyance direction and causes the position of the light emitting element 201 of the light emitting unit 110 to coincide with the position of the light receiving element 202 of the light receiving unit 111.

It is possible to move the light receiving unit 111 to the label leading end portion 503 in the direction B1 orthogonal to the conveyance direction on the basis of the output light (the inspection signal) from the light emitting unit 110 as described above. However, it is possible to move the light receiving unit 111 in an opposite manner. The light receiving unit 111 can first move the light receiving element 202 to B1*d* using the information indicating the position of the image leading end portion 403 of the image data, and the light emitting element 201 of the light emitting unit 110 can be moved to B1*b* without using the information indicating the position of the image leading end portion 403 of the image data. At this time, it is preferable to move the light emitting element 201 while detecting the light receiving level change in the light receiving element 202.

Figure 6B:
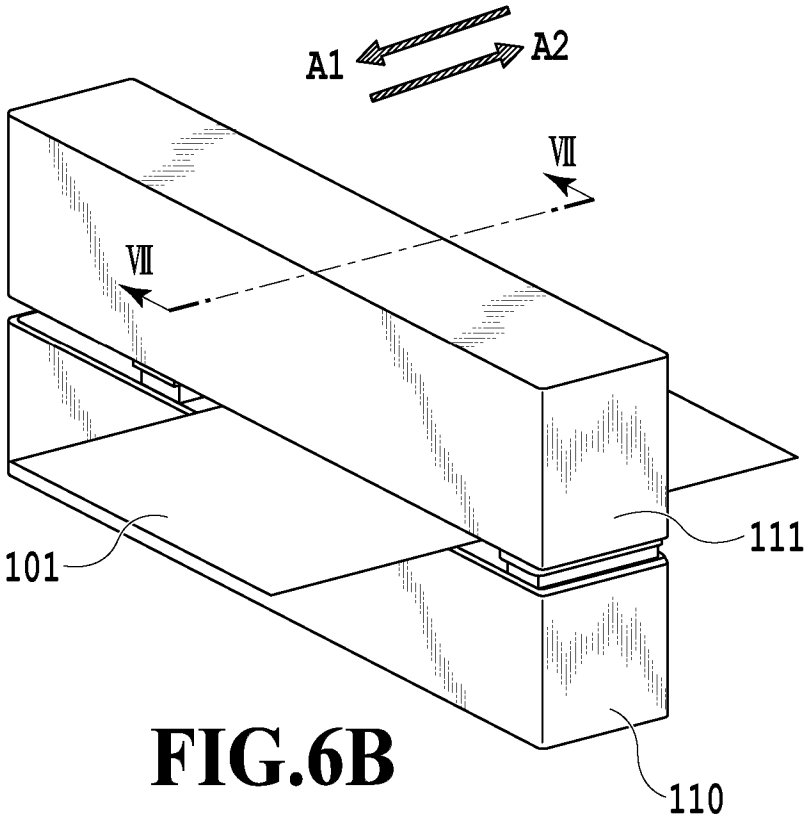
FIGS. 6A and 6B are diagrams illustrating a position relation of a light emitting unit and a light receiving unit of a sensor.
Figure 6A:
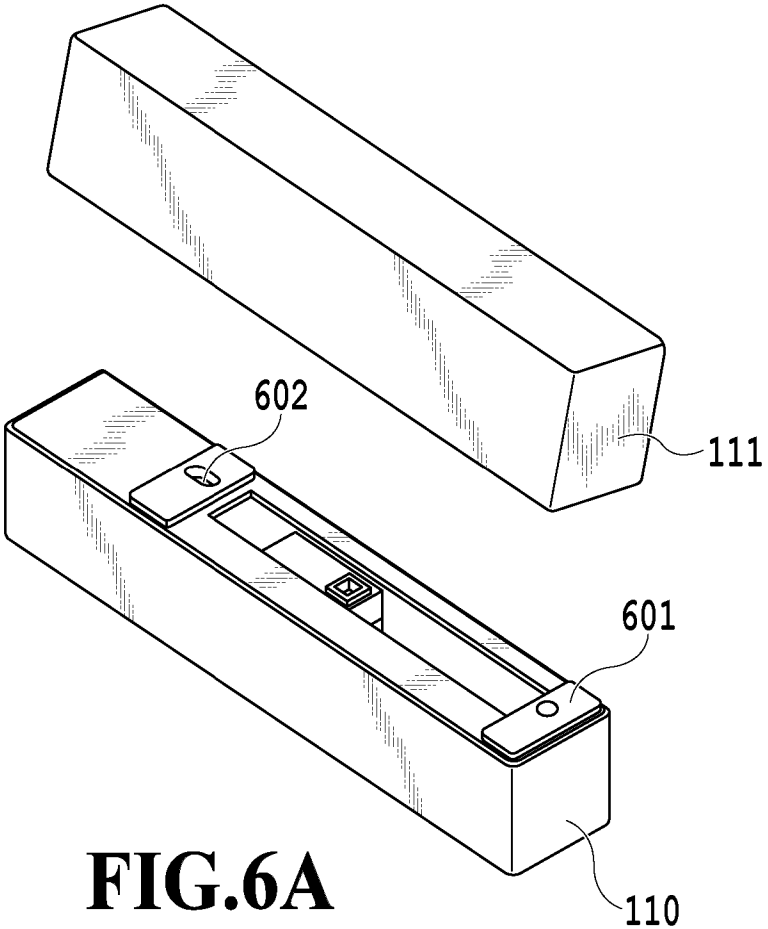

FIGS. 6A and 6B are diagrams illustrating a position relation of the light emitting unit and the light receiving unit of the transmissive TOF sensor unit serving as the sensor 200. FIG. 6A illustrates a position relation in a state in which the light emitting unit 110 and the light receiving unit 111 are separated. In the printing apparatus, it is necessary to perform a work of removing a print sheet (hereinafter referred to as a jam processing work) when a jam occurs as the print sheet is buckled, bent, caught, or the like. When the jam processing work is performed, the light emitting unit 110 and the light receiving unit 111 are in a position relation in which they are separated in conjunction with a housing portion of the printing apparatus as illustrated in FIG. 6A. As such a position relation is formed, it is possible to prevent the light emitting unit 110 and the light receiving unit 111 from being damaged by the print sheet at the time of jam processing while making the jam processing work easier. For example, when the jam processing work is not performed, and an image is printed on the base 101, the printing apparatus becomes a form of FIG. 6B.

FIG. 6B illustrates a form in which the light receiving unit 111 is mounted directly above the light emitting unit 110 of the transmissive TOF sensor unit in the vertical direction. The base 101 can be detected when the light receiving unit 111 is mounted on the light emitting unit 110 in the vertical direction as illustrated in FIG. 6B. An inspecting unit is configured such that the base 101 passes between the light emitting unit 110 and the light receiving unit 111 when the conveyance operation is performed in the conveyance direction of A1 or A2 in order to form an image on the base 101. The positioning of the light emitting unit 110 and the light receiving unit 111 in the conveyance direction is performed by a locating hole 601 and an oblong hole 602. The positioning is performed such that positioning pins of the light receiving unit 111 (not illustrated in FIG. 6A) are inserted into the locating hole 601 and the oblong hole 602 of the light emitting unit 110 illustrated in FIG. 6A.

When the position relation of the light emitting unit 110 and the light receiving unit 111 in the conveyance direction is decided by the positioning pin, the position of the light emitting element 201 in the conveyance direction may not coincide with the position of the light receiving element 202 in the conveyance direction in the vertical direction due to a mechanical manufacturing error. At this time, since an optical axis connecting the light emitting element 201 with the light receiving element 202 is oblique, a detection timing of the leading end portion of the print sheet gets faster or slower. Accordingly, a timing at which an image starts to be formed on the base 101 may be shifted. In the printing apparatus of the present invention, a distance from the printing position of the print head 105K to the optical axis connecting the light emitting element 201 with the light receiving element 202 is defined as a T-K gap. In a case where the print image is formed on the base 101 at an earlier timing, it is preferable to perform correction of reducing the T-K gap to be smaller than a default distance. Further, in a case where the print image is formed on the base 101 at a slower timing, it is possible to cause an image forming timing of the base 101 to coincide with an image forming start timing by the print head 105 by performing correction of increasing the TK gap to be larger than the default distance.

Figure 7:
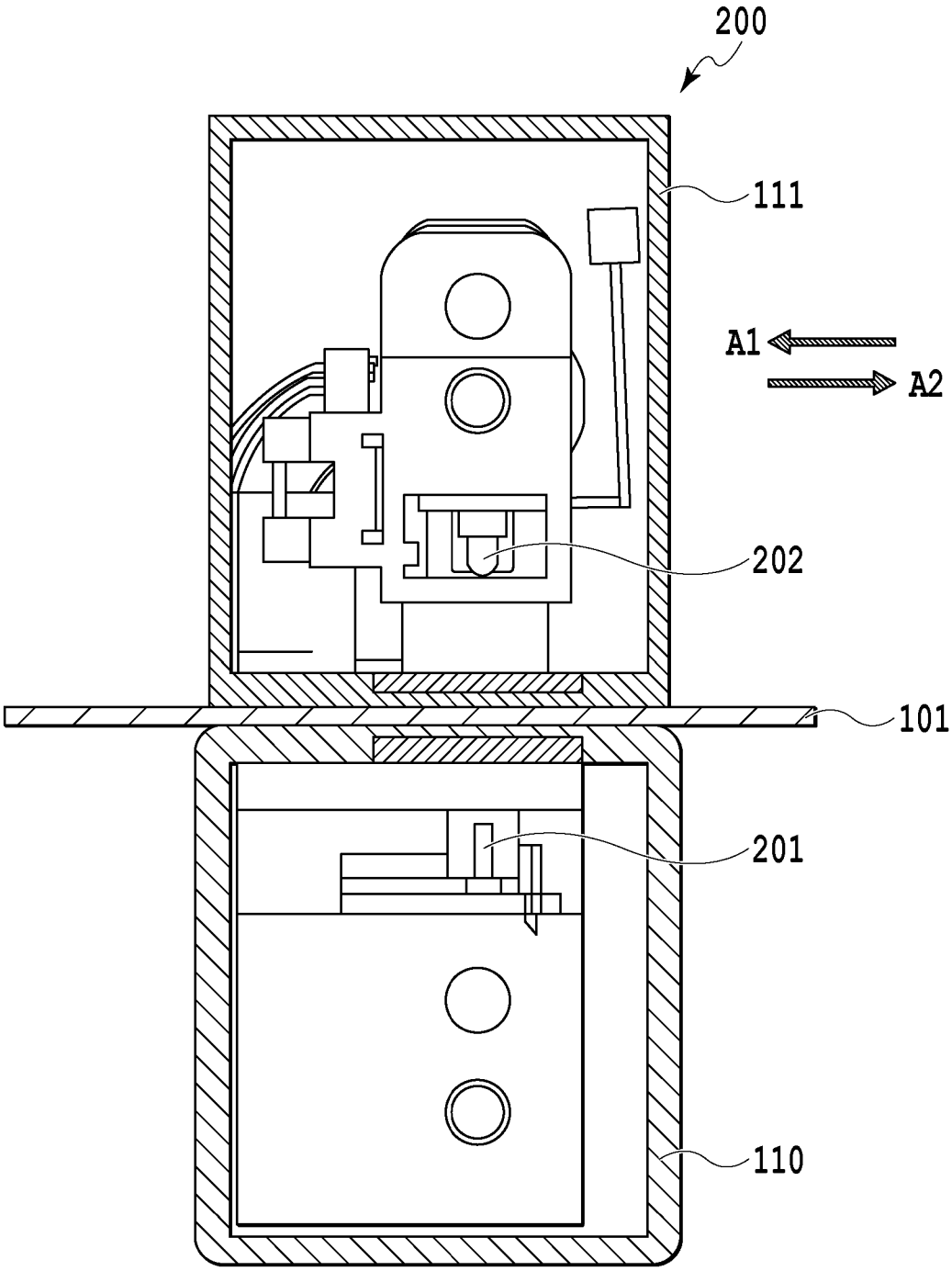
FIG. 7 is a diagram illustrating a cross-sectional configuration of a sensor.

FIG. 7 is a diagram illustrating a configuration of a cross section of the sensor 200. FIG. 7 is a cross-sectional view obtained by taking a portion near the center along a cross section including a line VII-VII in the sensor 200 illustrated in FIG. 6B. The sensor 200 includes the light emitting unit 110 and the light receiving unit 111. In order to form an image on the base 101, the base 101 is conveyed in the conveyance direction of A1 by the conveying unit 102. At that time, the base 101 passes between the light emitting element 201 of the light emitting unit 110 of the transmissive TOF sensor unit and the light receiving element 202 of the light receiving unit 111 as illustrated in FIG. 7.

As described above, in the sensor 200 in the printing apparatus of the present invention, it is possible to specify the label leading end portion 503 by causing the light emitting unit 110 and the light receiving unit 111 to be independently moved on the basis of the information indicating the position of the image leading end portion 403 of the image data transmitted from the host PC 320. It is also possible to cause the light receiving unit 111 to be dependently moved in accordance with the position of the light emitting unit 110 already specified by the label leading end portion 503. In any method, after the label leading end portion 503 is specified, the light emitting unit 110 and the light receiving unit 111 in the sensor 200 are positioned to face each other in the vertical direction and enter a standby state. In the printing apparatus of the present invention, it should be noted that, in this standby state, the label leading end portion 503 in the direction of B1 orthogonal to the conveyance direction is reliably specified. Next, as a more specific embodiment, a procedure of detecting the position of the label leading end portion 503 of the print medium after the sensor 200 enters the standby state will be described with reference to flowcharts.

First Embodiment

Figure 8:
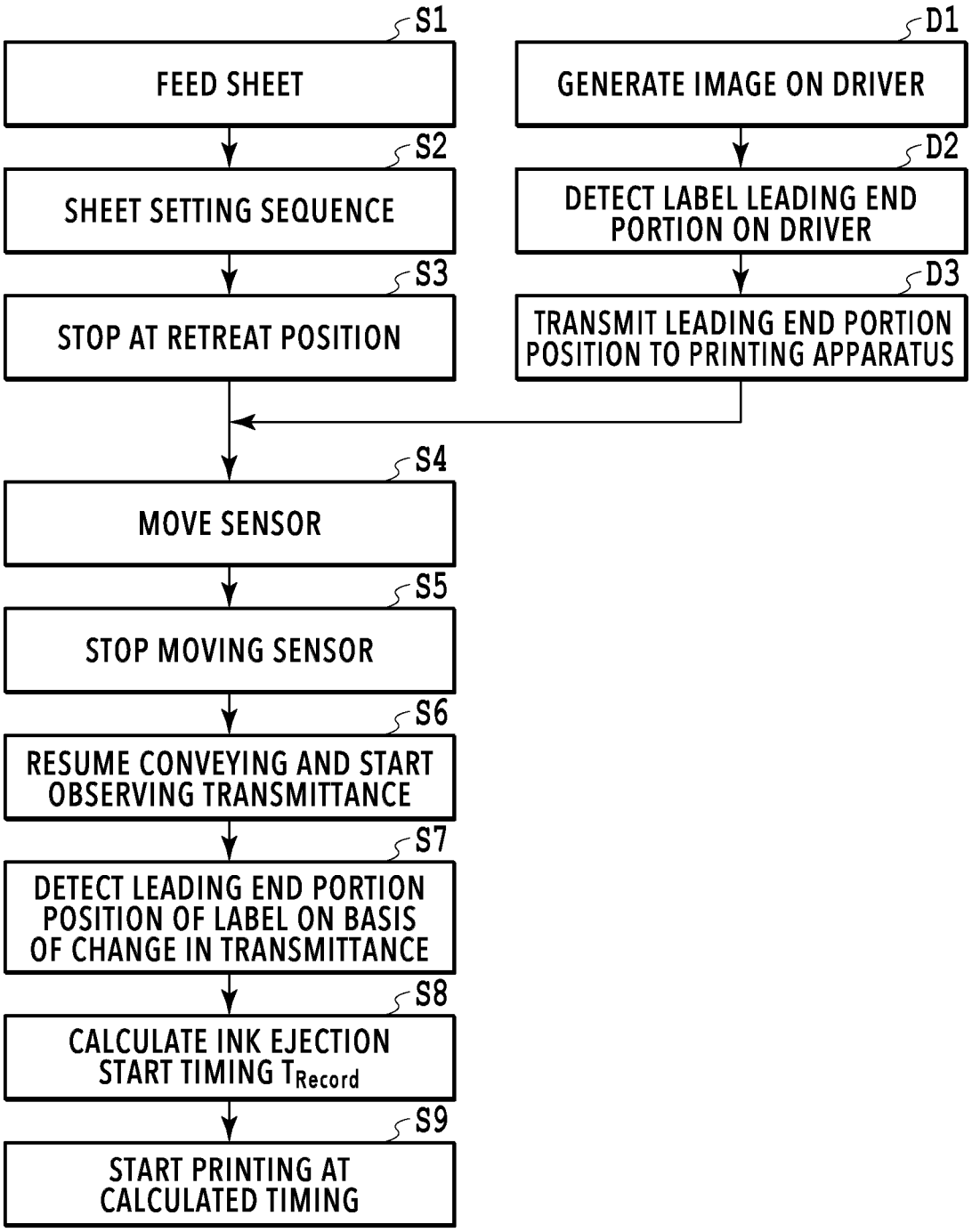
FIG. 8 is a flowchart up to a printing start in a printing apparatus according to the present invention.

FIG. 8 is a flowchart, the CPU 301 as the control unit illustrating processing procedures of specifying and detecting the leading end portion position of the print medium and of a process for starting the printing operation in the printing apparatus of the present invention. An operation example of a first embodiment in the printing apparatus of the present invention will be described. The light emitting unit 110 and the light receiving unit 111 specify the position of the label leading end portion 503 of the print medium on the basis of the image data generated on the host PC 320. A process of moving the sensor 200 (the light emitting element and the light receiving element) to the specified leading end portion position, then detecting the leading end portion position in the conveyance direction by the sensor 200, and starting printing will be described with reference to FIG. 8. The flowchart shown in FIG. 8 illustrates a processing procedure in a case where it is possible to move the light emitting unit 110 and the light receiving unit 111 independently. In this respect, the flowchart shown in FIG. 8 differs from another process example in which the light receiving unit 111 is moved on the basis of the light receiving level of the inspection signal after the light emitting unit 110 is moved, which will be described with reference to a flowchart shown in FIG. 9.

Referring to the flowchart shown in FIG. 8, in an operation step 1 (hereinafter abbreviated as S1), a sheet serving as a print medium is supplied. On the printing apparatus, the base 101 is fed to the regulating unit 103 through the sheet feeding unit 104. At this time, the base 101 is fed while abutting on the reference wall 114 of the regulating unit 103. Although not illustrated in FIG. 1, the print medium is fed while regulating movement and deviation of the print medium in the direction intersecting the conveyance direction by a width regulating guide in front facing the reference wall 114. In other words, the print medium is conveyed in the conveyance direction while regulating the deviation in the direction intersecting the conveyance direction using the reference end 501 of the print medium as a base point. In operation S1, the leading end portion of the base 101 is pinched between the conveying roller 106 and the pinch roller 107.

Then, in operation S2 shown in FIG. 8, in a state in which the base 101 is pinched by the conveying roller 106 and the pinch roller 107, the conveying roller driving motor 109 starts to be driven, and the conveying roller 106 rotates predetermined times. Thus, the base 101 is conveyed a predetermined distance in the conveyance direction A1. If the base 101 is conveyed, the leading end portion of the base 101 reaches a position of 5 mm at an upstream side in the conveyance direction from the light emitting unit 110 and the light receiving unit 111 of the transmissive TOF sensor unit. It should be noted that the leading end portion here means a base, for example, the leading end portion of the base. At this point, CPU 301 stops the conveyance driving of the base 101. As will be described later in FIGS. 11A to 11C, in the printing apparatus of the present invention, this stop position is defined as a "retreat position." Therefore, in operation S2 of a sheet setting sequence, the base 101 is moved to the retreat position after operation S1 of a sheet feeding process.

After operation S2 of the sheet setting sequence, in operation S3, the base 101 is stopped at the retreat position and enters the standby state. In parallel with the execution of operations S1 to S3 described above, in operation D1, image data to be transmitted to the printing apparatus later is generated on, for example, the driver of the host PC 320.

An image to be printed by the user using application software or the like is generated in the host PC 320. In operation D1, if the printing process is started in the application software, an image is generated on the driver of the host PC. When the image is generated on the memory space of the driver, in operation D2, the label image leading end portion 403 of the image data is detected.

Then, in operation D3 of the flowchart in FIG. 8, the image leading end portion 403 of the image data is specified in the image data generated on the driver, and leading end portion position information, that is, the information (Xfront) indicating the position of the image leading end portion 403 of the image data is transmitted to the printing apparatus.

In the present embodiment, the example in which the host PC 320 specifies the label leading end portion 503 on the basis of the image leading end portion 403 of the image data and transmits it to the printing apparatus has been described above. However, the host PC 320 may specify the label leading end portion 503 on the basis of shape information of the label used for printing and transmit it to the printing apparatus.

Referring back to the printing apparatus again, in operation S4 shown in FIG. 8, the information (Xfront) indicating the position of the image leading end portion 403 of the image data is received from the driver in the state (S3) in which the base 101 is stopped at the retreat position (S3). Upon receiving the information indicating the position of the image leading end portion 403 of the image data, the light emitting element 201 of the light emitting unit 110 and the light receiving element 202 of the light receiving unit 111 of the transmissive TOF sensor starts to be moved. The flowchart shown in FIG. 8 illustrates a processing procedure in a case where the sensor 200 is constituted by two units (the light emitting unit 110 and the light receiving unit 111), and the light emitting unit 110 and light receiving unit 111 can be moved independently. Therefore, the light emitting element 201 of the light emitting unit 110 and the light receiving element 202 of the light receiving unit 111 receive the information (X front) indicating the position of the image leading end portion 403 and can be independently moved to the position B1*b* and B1*d* of the label leading end portion 503. Both of the two units, that is, the light emitting unit 110 and the light receiving unit 111 can be moved in the direction intersecting the conveyance direction on the basis of the information indicating the leading end portion position specified in the image data and can detect an arrival of the label at the position corresponding to the label leading end portion 503.

Even if the stop positions of the light emitting unit 110 and the light receiving unit 111 are slightly deviated, it does not matter if the image leading end portion 403 is within a range in which it can be detected by the sensor 200.

The specifying of the position of the label leading end portion 503 in the two units of the transmissive TOF sensor is completed on the basis of the information indicating the position of the image leading end portion 403 of the image data transmitted from the driver. Here, the movement of the light emitting element 201 of the light emitting unit 110 and the light receiving element 202 of the light receiving unit 111 of the TOF sensor is stopped. This operation is indicated by S5. After operation S5, in this state, the light emitting element 201 and the light receiving element 202 are on standby at the leading end portion positions B1*b* and B1*d* of the label 505 on the base 101 in the direction (B1 or B2) intersecting the conveyance direction. Further, as described above in S2, the base 101 enters the standby state at the retreat position.

Then, in operations S6 to S7 of the flowchart shown in FIG. 8, the leading end portion of the label 505 on the base 101 in the conveyance direction (A1 or A2) is detected. In operation S6, driving of the conveying roller driving motor 109 is started again, and the print medium is further conveyed from the retreat position in the conveyance direction of A1. At this time, the light receiving element 202 of the light receiving unit of the TOF sensor starts continuous monitoring of an amount of received light. In operation S6, the base 101 is gradually conveyed from the retreat position toward the print head 105 in the conveyance direction A1.

If the base 101 is further conveyed, in operation S7, detection of the position of the label leading end portion 503 is executed on the basis of the change in the light receiving level in which light transmittances of a material of the base of the print medium and a material of the label are reflected. First, the base end portion passes over the light emitting element 201 of the light emitting unit 110 of the TOF sensor in the conveyance direction of A1. Thereafter, the leading end portion position of the label formed on the base reaches the light emitting element 201 of the TOF sensor light emitting unit 110 in the vertical position. The leading end portion position corresponds to the label leading end portion 503 in the real space shown in FIG. 4B. The light receiving level of the light receiving element 202 of the light receiving unit 111 during operations S6 and S7 varies substantially as illustrated in FIG. 10 with a series of movement forms of the base 101.

Figure 10:
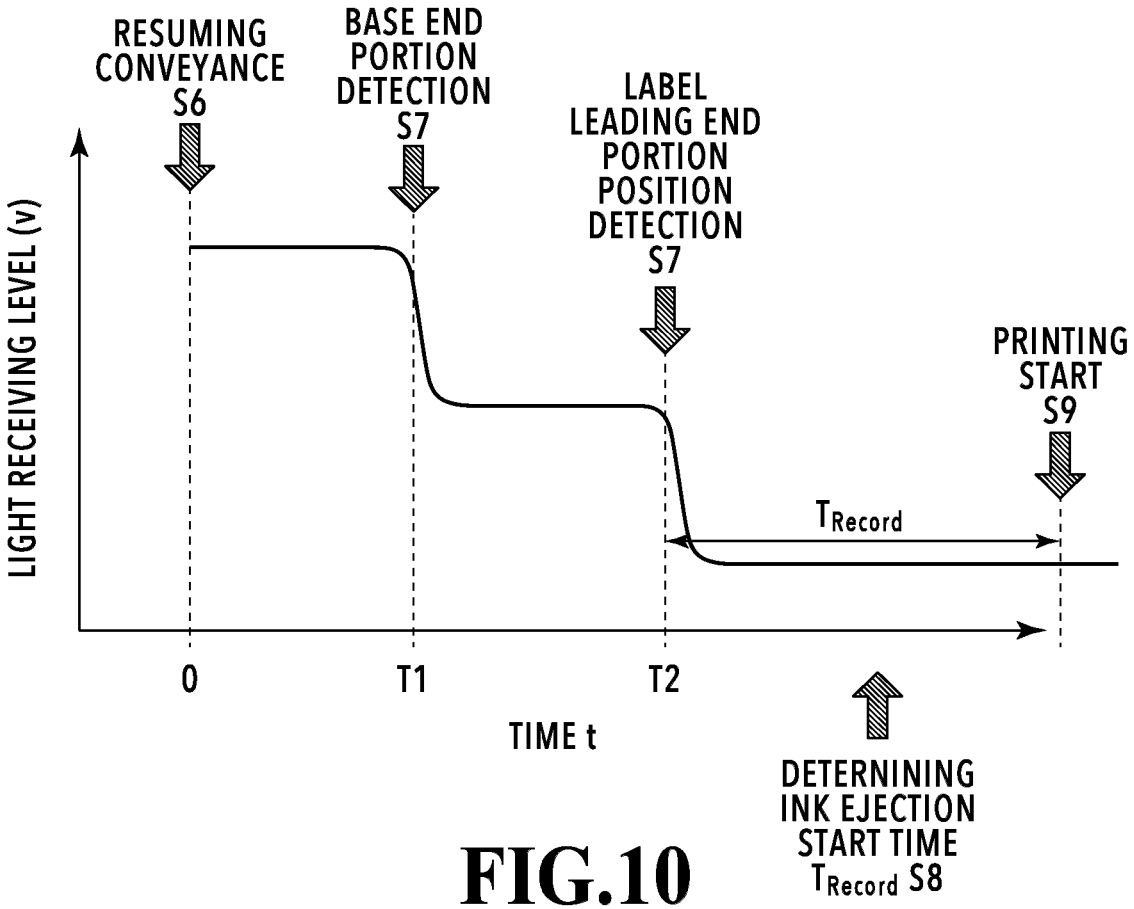
FIG. 10 is a diagram illustrating a light receiving level change during leading end portion detection by a transmissive sensor.

FIG. 10 is a diagram illustrating a temporal change in the light receiving level observed by the light receiving element of the TOF sensor in operations S6 to S7. In FIG. 10, a vertical axis indicates the light receiving level (voltage), and a horizontal axis indicates a lapse of time when a time at which the conveyance of the print medium is started again (S 6) is set to t=0. If the conveyance speed of the print medium is constant, the horizontal axis indicates a movement amount of the base 101 from the retreat position to the conveyance direction. At a time T1, the base end portion passes over the light emitting element 201 of the sensor light emitting unit 110, and at a time T2, the leading end portion position of the label reaches above the light emitting element 201 in the vertical direction.

Figure 11A:
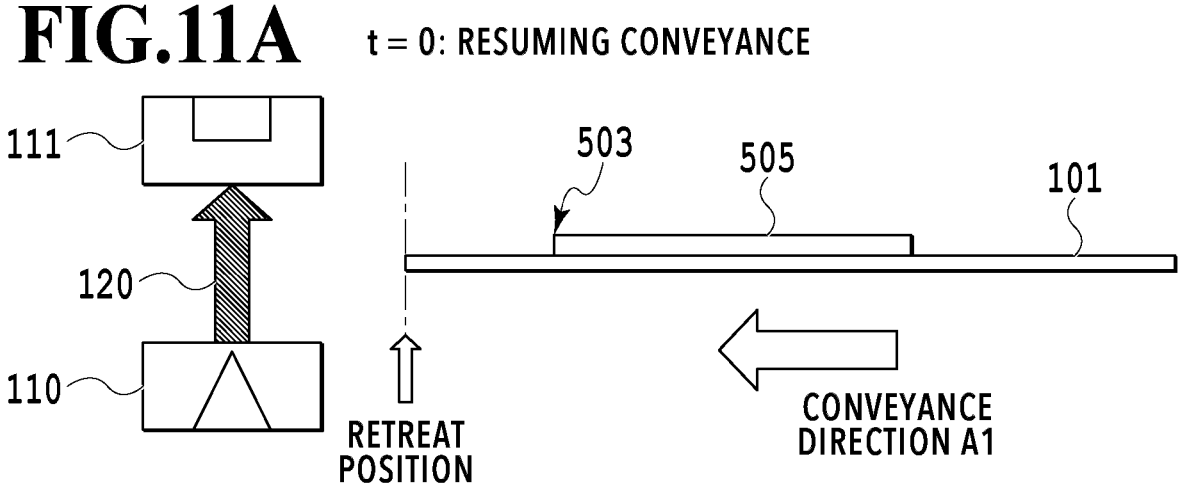
FIGS. 11A to 11C are diagrams for describing a leading end portion detection operation of a transmissive sensor.
Figure 11B:
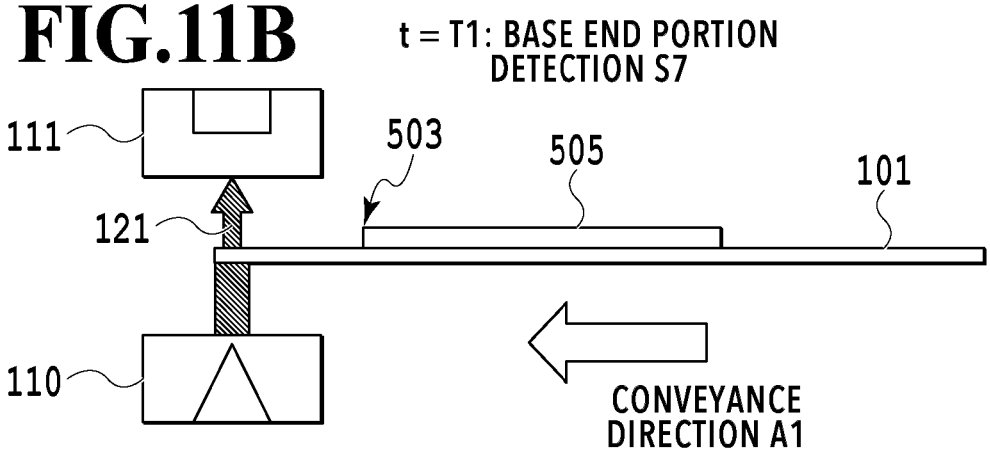
Figure 11C:
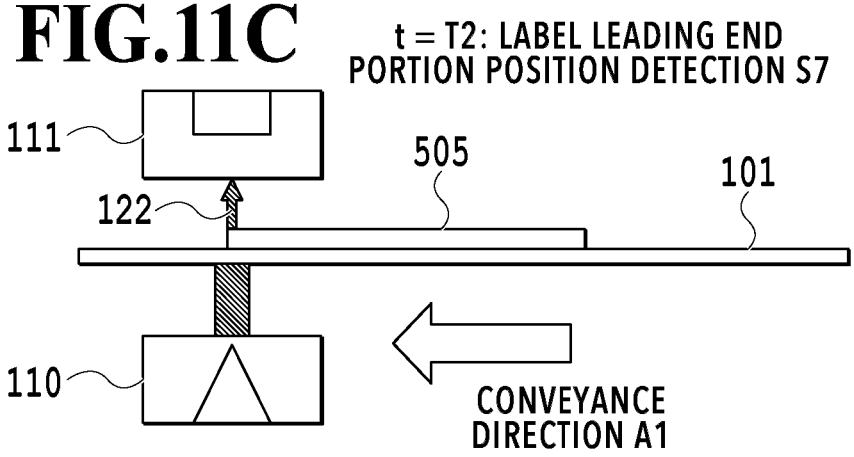

FIGS. 11A to 11C are diagrams illustrating a leading end portion detection operation by the transmissive sensor. The states at the respective times (t=0, T1, and T2) in FIG. 10 are illustrated in FIGS. 11A, 11B, and 11C. FIG. 11A illustrates a state in which the conveyance of the base 101 is resumed from the retreat position in operation S6. FIG. 11B illustrates at state in which the base 101 is conveyed by 5 mm from the retreat position, and the end portion of the base 101 reaches the position of the light emitting element 201 and the light receiving element 202 of the TOF sensor (t=T1 shown in FIG. 10). In this state, the light transmittance of the material of the base of the print medium is reflected, and the light receiving level of the light receiving element 202 decreases. A decrease speed or a change profile of the light receiving level depend on a beam radius, a beam profile, or the like of light beams serving as the inspection signal output from the light emitting element 201. If the property of the light beam serving as the inspection signal is known in advance, it is possible to perform correction appropriately if necessary and specify the time T1 in which the center position of the light emitting element 201 of the light emitting unit 110 coincides with the end position of the base 101.

In operation S7, if the base 101 of the print medium is further conveyed, the label leading end portion 503 corresponding to the leading end of the label 505 reaches a position just below the light receiving element 202 of the TOF sensor light receiving unit and enters a state of FIG. 11C (T=T2 in FIG. 10). The light transmittances of the material of the base 101 and the material of the label 505 are reflected, and the light receiving level of the light receiving element 202 usually decreases further. Similarly to the case of the time T1, it is possible to specify the time T 2 at which the center position of the light emitting element 201 and the light receiving element 202 coincides with the position of the label leading end portion 503 of the label 505.

In the printing apparatus of the present invention, at the stage of operation S5 shown in FIG. 8, the position of the label leading end portion 503 in the direction intersecting the conveyance direction (the width direction of the print medium) has already been specified by the sensor 200. In other words, each of the light emitting unit 110 and the light receiving unit 111, which are the two units of the sensor 200 specifies the label leading end portion 503 in the direction intersecting the conveyance direction. Then, the light emitting unit 110 and the light receiving unit 111 calculate the movement amount of the light emitting element 201 and the light receiving element 202 with reference to an extended line in the conveyance direction of the reference wall 114 in the width direction of the print medium. Then, the light emitting element 201 and the light receiving element 202 are moved in accordance with the calculated movement amount and enter the standby state.

If the light emitting element 201 and the light receiving element 202 are caused to be on standby for the label leading end portion 503 specified in the direction intersecting the conveyance direction, it is possible to make the state in which the sensor 200 is reliably aligned with the position of the label leading end portion 503 regardless of the shape of the label. Operation S5 is completed, and the light emitting element and the light receiving element are caused to be on standby at the specified position described above. Then, the conveyance of the base 101 is resumed, the light receiving level change of the light receiving element 202 is monitored, and thus it is possible to decide the detection time T1 of the end portion of the base 101 and the detection time T2 of the position of the label leading end portion 503.

In general, in the printing apparatus, the conveyance speed and the conveyance distance of the print medium (base) in the conveying unit 102 are known to the printing apparatus and monitored by the code wheel 113. Further, a distance from the light emitting element 201 and the light receiving element 202 of the TOF sensor to the printing start position of the print head 105 and a position relation thereof are also known. Therefore, it is possible to decide a time period TRecord from the time T2 to the printing start in the print head 105 (an ink ejection start) on the basis of T1 and T2 and the conveyance speed detected by the printing apparatus. The control unit such as the CPU 301 of the printing apparatus starts printing the image in the print region on the basis of the information obtained from the leading end portion position detected in the conveyance direction.

As described above, in the printing apparatus of the present invention, the leading end portion position in the direction intersecting the conveyance direction is accurately specified by the sensor 200 (the light emitting unit 110 and the light receiving unit 111) (S4 and S5). Further, as operations S6 to S7 described above are performed, the leading end portion position specified by operations S4 and S5 in the intersecting direction, that is, the label leading end portion 503 in the conveyance direction is detected regardless of the shape of the label 505 formed on the base 101. Further, printing can be started at an appropriate timing on the basis of the information obtained from the leading end portion detected in the conveyance direction. In other words, since printing can be started in operation S9 on the basis of the time period TRecord which is the time information calculated in S8, printing can be performed with no difference in position between an image to be printed and the label 505.

In the present embodiment, the example in which T1 and T2 are detected has been described, and the example is under the assumption that a first label 505 on the sheet 101 is conveyed. In a case where a second label 505 and subsequent labels 505 are conveyed, the light receiving element 202 alternately outputs the light receiving level for the sheet 101 and the light receiving level for the label 505. In other words, T1 serving as the leading end of the continuous base 101 is not detected, and T2 serving as the label leading end portion 503 is repeatedly detected.

The CPU 301 sets TRecord for the timing of T2 to be output twice or more, and performs printing on a plurality of labels 505. Further, TRecord may be calculated in advance by the host PC 320 to be transmitted to the printing apparatus.

As apparent from the flowchart shown in FIG. 8, the present invention also has an aspect as a method of detecting the label in a printing apparatus that forms an image on a print medium including a base and a label formed on the base. In other words, a step of conveying the print medium while regulating one reference end of the print medium in a conveyance direction is performed. Then, a step of specifying a leading end portion position from the reference end of the print region in a direction intersecting the conveyance direction on the basis of information indicating a leading end portion position of image data corresponding to an image to be formed on the label of the print medium is performed. Further, a step of outputting an inspection signal to the print medium at the specified leading end portion position and a step of acquiring a detection signal in which the base or the label is reflected in accordance with the inspection signal are performed. Finally, the leading end portion position of the label in the conveyance direction is detected on the basis of the detection signal level change.

In the printing apparatus of the present embodiment, the sensor 200 is constituted by the two units (the light emitting unit 110 and the light receiving unit 111). Since it is preferable that any unit include a single light emitting element or a single light receiving element, an expensive CIS including a plurality of light receiving elements arranged in an array form is unnecessary. A problem in that external light comes into and a problem in that a temperature increases in a case where it is continuously used are ignorable levels, and there is no problem in exhaust heat of the apparatus. As compared with the CIS, it is possible to detect the leading end portion in the print medium at a low cost even when the mechanism of driving the two units of the sensor is installed. Further, for the detection of the leading end portion, a special mechanism such as a fitting unit is not necessary, and a regulating mechanism and a conveying mechanism which are originally installed in the printing apparatus can be used. Further, since the print medium uses an original shape of a label, it is unnecessary to mark the back side of the print sheet.

Second Embodiment

Figure 9:
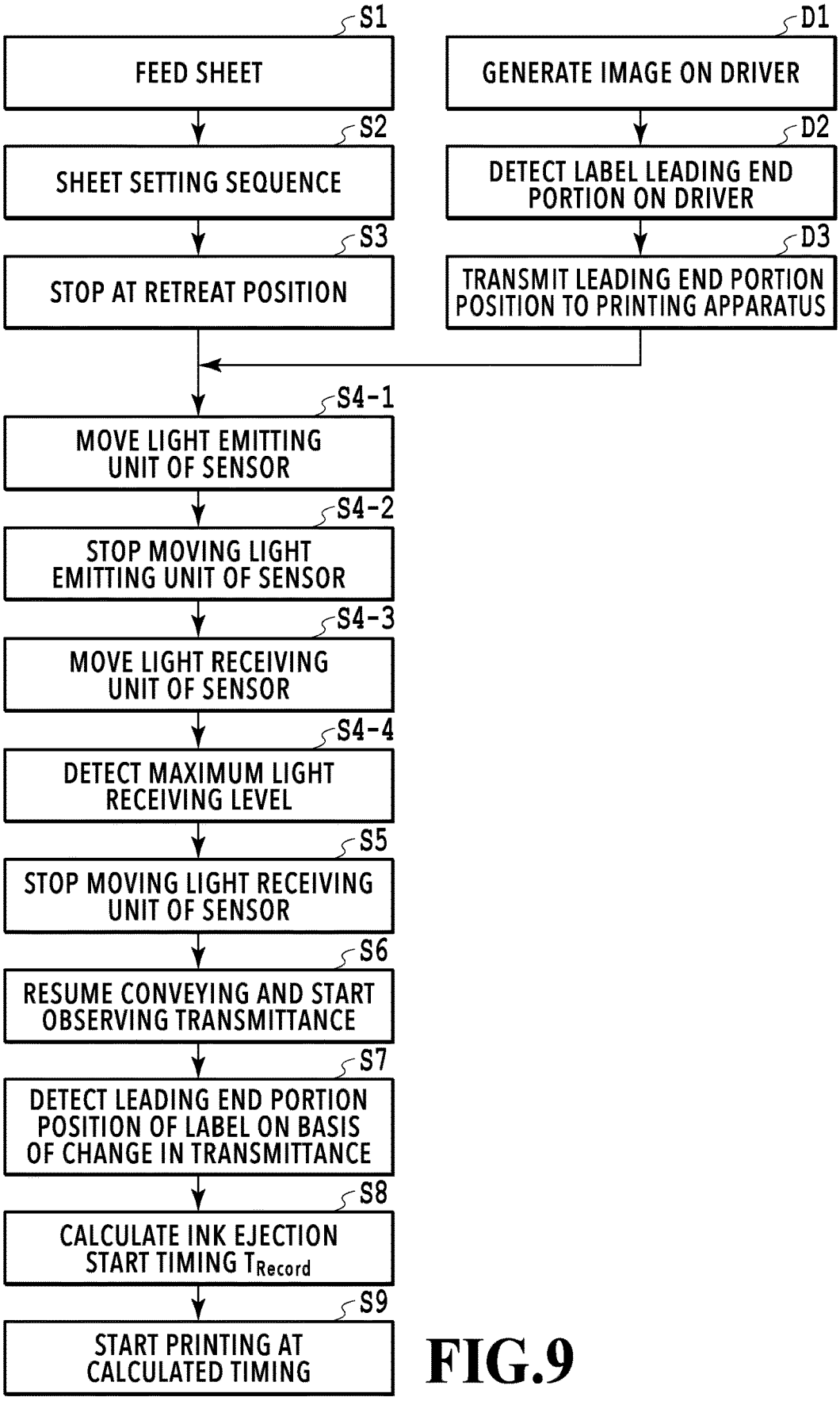
FIG. 9 is another flowchart up to a printing start in a printing apparatus according to the present invention.

FIG. 9 is a flowchart, the CPU 301 as the control unit, illustrating another processing procedure of specifying identifying and detecting the leading end portion position of the base and starting printing in the printing apparatus of the present invention. An operation example of a second embodiment in the printing apparatus of the present invention will be described. In the processing procedure illustrated in FIG. 8, each of the light emitting unit 110 and the light receiving unit 111 receives the information indicating the position of the image leading end portion 403 of the image data from the host PC 320, independently specifies the leading end portion position of the label, and enters the standby state at this position. On the other hand, in the processing procedure of the present embodiment shown in FIG. 9, the light receiving unit 111 is moved to the leading end portion position of the label on the basis of the light receiving level of light serving as the inspection signal from the light emitting unit 110. In the flowchart shown in FIG. 9, operations S1 to S3 and D1 to D3 are the same as those shown in FIG. 8. Further, operations S6 to S9 in FIG. 8 are also the same as operations S6 to S9 shown in FIG. 9. A difference between the two processing procedures lies in that operation S4 shown in FIG. 8 is different from operations S4-1 to S4-4 shown in FIG. 9, and the description will proceed focusing on this portion.

In the flowchart shown in FIG. 9, if the conveyance of the base 101 is stopped at the retreat position (S3), the information (Xfront) indicating the position of the image leading end portion 403 of the image data is received from the host PC 320 (D3). In operation S4-1 of the flowchart shown in FIG. 9, only the light emitting unit 110 of the transmissive TOF sensor starts to move in the direction intersecting the conveyance direction on the basis of the information indicating the position of the image leading end portion 403. Then, in operation S4-2, the light emitting unit 110 stops its movement at the position of the label leading end portion 503 on the base 101 specified on the basis of the information indicating the position of the image leading end portion 403 of the image data.

If the light emitting unit 110 completes the movement, in operation S4-3, the light receiving element 202 of the light receiving unit 111 of the transmissive TOF sensor starts to move. The light receiving element 202 of the light receiving unit 111 specifies a position at which the light receiving level is maximum while detecting the light serving as the inspection signal from the light emitting element 201 instead of receiving the information indicating the position of the image leading end portion 403 of the image data from the host PC 320. This is the process of detecting the maximum light receiving level in the direction (B1 or B2) intersecting the conveyance direction in operation S4-4 of the flowchart shown in FIG. 9. The light receiving element 202 stops its movement at the position at which the maximum light receiving level is detected in the direction intersecting the conveyance direction (S5). The operation in which the light receiving element 202 specifies the maximum position of the light receiving level has already been described with reference to FIG. 5.

When the light receiving element 202 stops its movement, the position at which the light receiving element 202 detects the maximum light receiving level is the position directly above the position at which the light emitting element 201 of the light emitting unit 110 is stopped in operation S4-2 in the vertical direction. The position at which light emitting element 201 is stopped is the position of label leading end portion 503 in the direction intersecting the conveyance direction (the width direction of the print medium). Therefore, in a series of operation processes of FIG. 9, the light receiving element 202 of the light receiving unit 111 is moved to the leading end portion position in the intersecting direction on the basis of the inspection signal from the light emitting element 201 and specifies the leading end portion position. In the flowchart shown in FIG. 9, a state in which operation S5 is completed is the same as the state in which operation S5 is completed in the flowchart shown in FIG. 8. It is the state in which the light emitting element 201 and the light receiving element 202 are on standby for the label leading end portion 503 specified in the direction intersecting the conveyance direction. In the state in which operation S5 is completed, it is possible to make the state in which the sensor 200 is reliably aligned with the position of the label leading end portion 503 in the direction intersecting the conveyance direction regardless of the shape of the label.

In the procedure illustrated in FIG. 9, the light receiving element 202 of the light receiving unit 111 can be set to the standby state (S5) on the basis of only the light receiving level of the inspection signal from the light emitting element 201 of the light emitting unit 110. Therefore, the light receiving unit 111 of the TOF sensor need not be moved to a specific position by the scale sensor 218 and the linear scale 204 as described above with reference to FIG. 2. The light receiving unit 111 may be able to move to the label leading end portion 503 in the direction intersecting the conveyance direction on the basis of the inspection signal from the light emitting unit 110. In the present embodiment, similarly to the first embodiment, the sensor 200 is constituted by the two units (the light emitting unit 110 and the light receiving unit 111). However, as compared with the configuration of the first embodiment, the mechanism of driving the light receiving unit 111 out of the two units of the sensor 200 can be greatly simplified. As compared with the case of the first embodiment, the cost for the sensor 200 can be further reduced.

In the second embodiment, the light receiving unit 111 is moved to the leading end portion position of the label on the basis of the light receiving level of the light serving as the inspection signal from the light emitting unit 110. However, a subordinate relation between the light emitting unit 110 and the light receiving unit 111 can be reversed. In this case, first, the light receiving unit 111 receives the information (Xfront) indicating the position of the image leading end portion 403 of the image data or the label shape data from the host PC 320 and is moved to the position of the label leading end portion 503 in the direction intersecting the conveyance direction. Thereafter, the light emitting element 201 of the light emitting unit 110 is moved in the direction intersecting the conveyance direction while outputting the inspection signal. During that period, the light receiving element 202 of the light receiving unit 111 monitors the light receiving level, and when the light receiving element 202 detects the maximum light receiving level, the movement of the light emitting element 201 is stopped. At this time, it becomes a state in which the light emitting element 201 and the light receiving element 202 are on standby for the label leading end portion 503 specified in the direction intersecting the conveyance direction. Eventually, it becomes the same state as the standby state in operation S5 shown in FIG. 9.

Therefore, when the sensor 200 includes the two units of the transmissive sensor, it is preferable that only one unit receive the information indicating the position of the image leading end portion 403 of the image data or the label shape data, and specify the position of the label leading end portion 503 in the direction intersecting the conveyance direction.

Third Embodiment

In the above description, the sensor 200 is constituted by the two units, that is, the light emitting unit 110 and the light receiving unit 111, and the light receiving level of the inspection signal from the light emitting element 201 is detected by the light receiving element 202. In other words, the leading end portion position is detected using the transmissive optical sensor on the basis of the transmittances of the material of the base 101 and the material of the label 505. However, a reflective optical sensor constituted by a single unit in which the light emitting unit 110 and the light receiving unit 111 are integrated can be used as the sensor in the printing apparatus of the present invention.

Figure 12A:
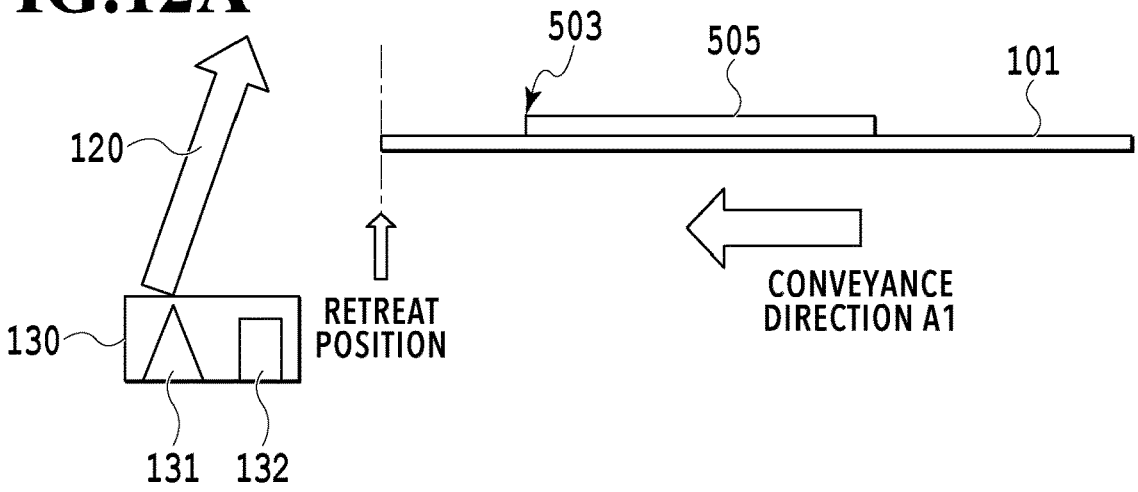
FIGS. 12A to 12C are diagrams for describing a leading end portion detection operation of a reflective sensor.
Figure 12B:
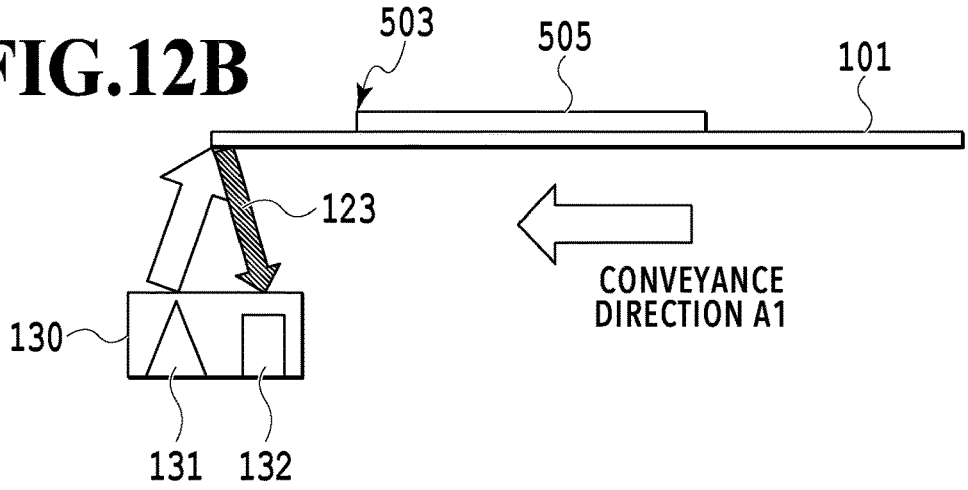
Figure 12C:
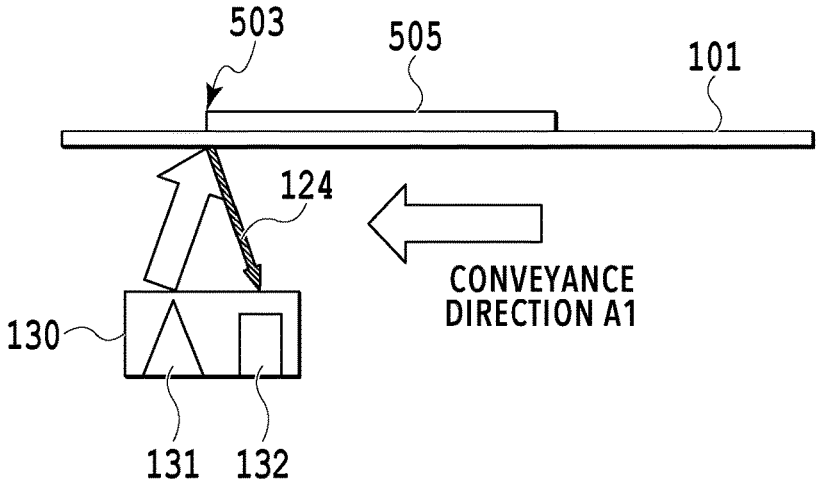

FIGS. 12A to 12C are diagrams for describing the operation of the leading end portion detection by the reflective TOF sensor. FIGS. 12A to 12C are similar to the position detection operation of the label leading end portion 503 by the sensor 200 of the transmissive TOF sensor described with reference to FIGS. 11A to 11C except that a type of sensor is reflective, and a single unit is employed. Due to the difference, the sensor 200 of the present embodiment includes only a single unit 130, and the unit 130 includes a light emitting element 131 and a light receiving element 132. The light emitting element 131 corresponds to a signal output unit which outputs the inspection signal to the print medium. Further, the light receiving element 132 corresponds to a signal acquiring unit that acquires a detection signal with a variable level in which a difference in a physical property of the print medium is reflected in accordance with the inspection signal. For example, the light emitting element 131 and the light receiving element 132 may be arranged at front and rear positions in the conveyance direction. The sensor of the single unit is not limited to a specific configuration if it is possible to output the inspection signal to the print medium at the position of the label leading end portion 503 specified in the direction intersecting the conveyance direction and acquire the detection signal in which the print medium is reflected.

As illustrated in FIG. 12B, if the end portion of the base 101 of the print medium reaches substantially the upper center of the unit 130, the light beams (the inspection signal) from the light emitting element 131 are partially reflected, and reflected light 123 is received by the light receiving element 132. It is preferable to appropriately decide the light emitting element 131 and the light receiving element 132 and a distance or a position relation of a reflection point in accordance with the property of the light beams serving as the inspection signal. As illustrated in FIG. 12C, if the base 101 is further conveyed, and the label leading end portion 503 reaches the reflection point, for example, a level of reflected light 124 decreases since light reflectance of the material of the base 101 is different from light reflectance of the material of the label 505.

Figure 13:
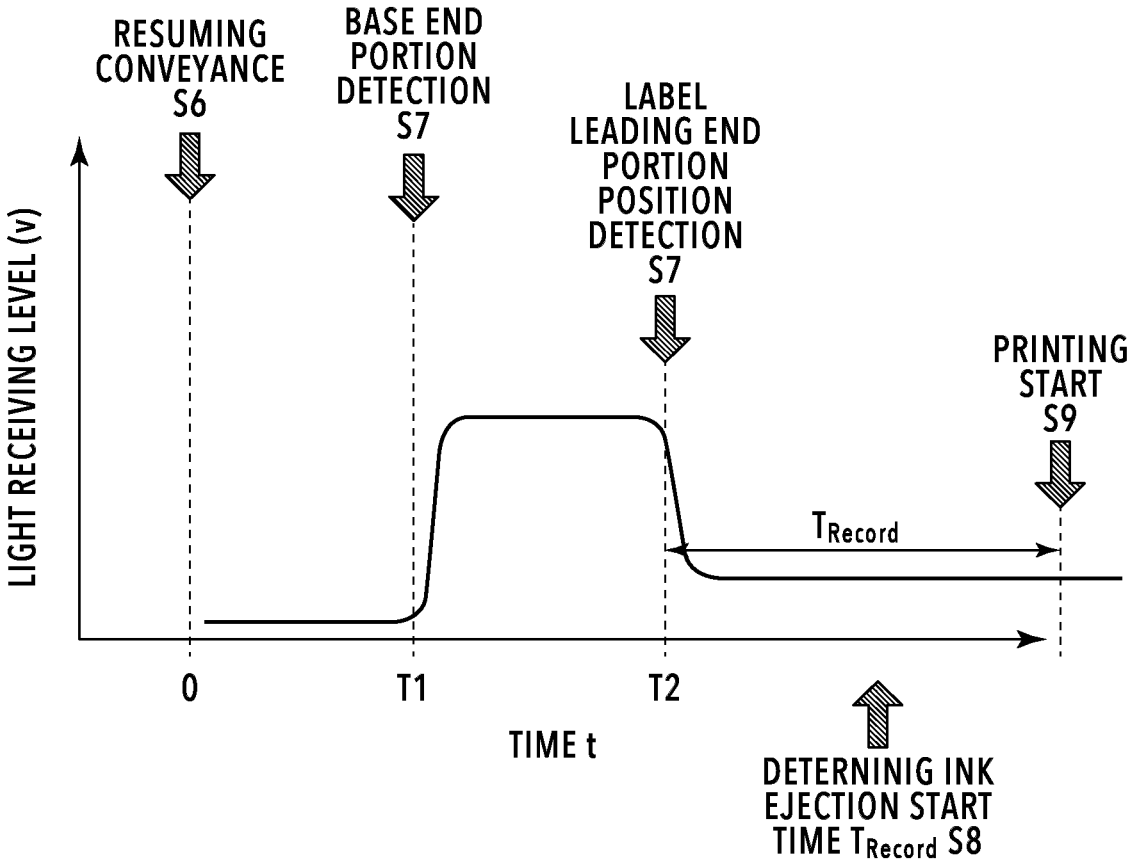
FIG. 13 is a diagram illustrating a light receiving level change during leading end portion detection by a transmissive sensor.

FIG. 13 is a diagram illustrating a temporal change in the light receiving level observed by the light receiving element of the reflective TOF sensor. It corresponds to the temporal change in the light receiving level observed by the light receiving element of the transmissive TOF sensor illustrated in FIG. 10. As illustrated in FIG. 13, the light receiving level of the light receiving element 132 of the reflective TOF sensor differs from that in the case of the transmissive TOF sensor shown in FIG. 10. However, it is not different in the point that it is possible to detect the end portion of the base 101 and the leading end portion of the label 505 on the basis of the change in the light receiving level. A light receiving level change pattern illustrated in FIG. 13 is an example, and the light receiving level after the label leading end portion 503 is detected (after t=T2) may be increased depending on the materials or the configurations of the base 101 and the label 505.

Even in a case where the label leading end portion 503 is detected by a reflective TOF sensor 130, the processing procedures in the flowcharts shown in FIGS. 8 and 9 are substantially the same. In the case of the reflective TOF sensor, the sensor 200 can be constituted by a single unit in which a light emitting element 131 and a light receiving element 132 are integrated. Therefore, operations S4 and S5 shown in FIG. 8 and operations S4-1 to S5 shown in FIG. 9 performed by the sensor 200 including the two units (the light emitting unit 110 and the light receiving unit 111) can be greatly simplified. Further, the transmittance change in the flowcharts shown in FIGS. 8 and 9 is replaced with the reflectance change.

Unlike the first and second embodiments using the transmissive TOF sensor, the printing apparatus of the present embodiment employs the reflective TOF sensor as the sensor. The sensor can be constituted by an integrated single unit that outputs the inspection signal and acquires the detection signal from the base or the print region. Therefore, as compared with the configurations of the first and second embodiments, the configuration of the sensor can be further simplified, and the cost can be reduced.

In the sensor 200 illustrated in FIGS. 12A to 12C, the single unit 130 is arranged below the base 101, and an inspection signal 120 is output to a surface having no label 505 of the print medium. However, the unit 130 may be arranged above the base 101, and the inspection signal 120 may be output to a surface on which the label 505 is formed. When the unit 130 is installed above the base 101, it is possible to more clearly detect a difference between the light reflectance of the material of the base 101 and the material of the label 505. In the sensor 200 using the reflective TOF sensor illustrated in FIG. 12A to 12C, the change in the light reflectance is detected as the level change of the detection signal. However, if the unit 130 is arranged above the base 101, a difference in height between the base and the label, that is, a difference in distance between the sensor and the print medium can be detected as the level change of the detection signal.

Fourth Embodiment

It is preferable to detect the label before the printing by the print head 105 is started in order to print an image at a correct position of the label. In this regard, in the present embodiment, an example in which the sensor is moved to a position at which the label can be detected before the printing is started will be described with reference to FIG. 15.

Figure 15:
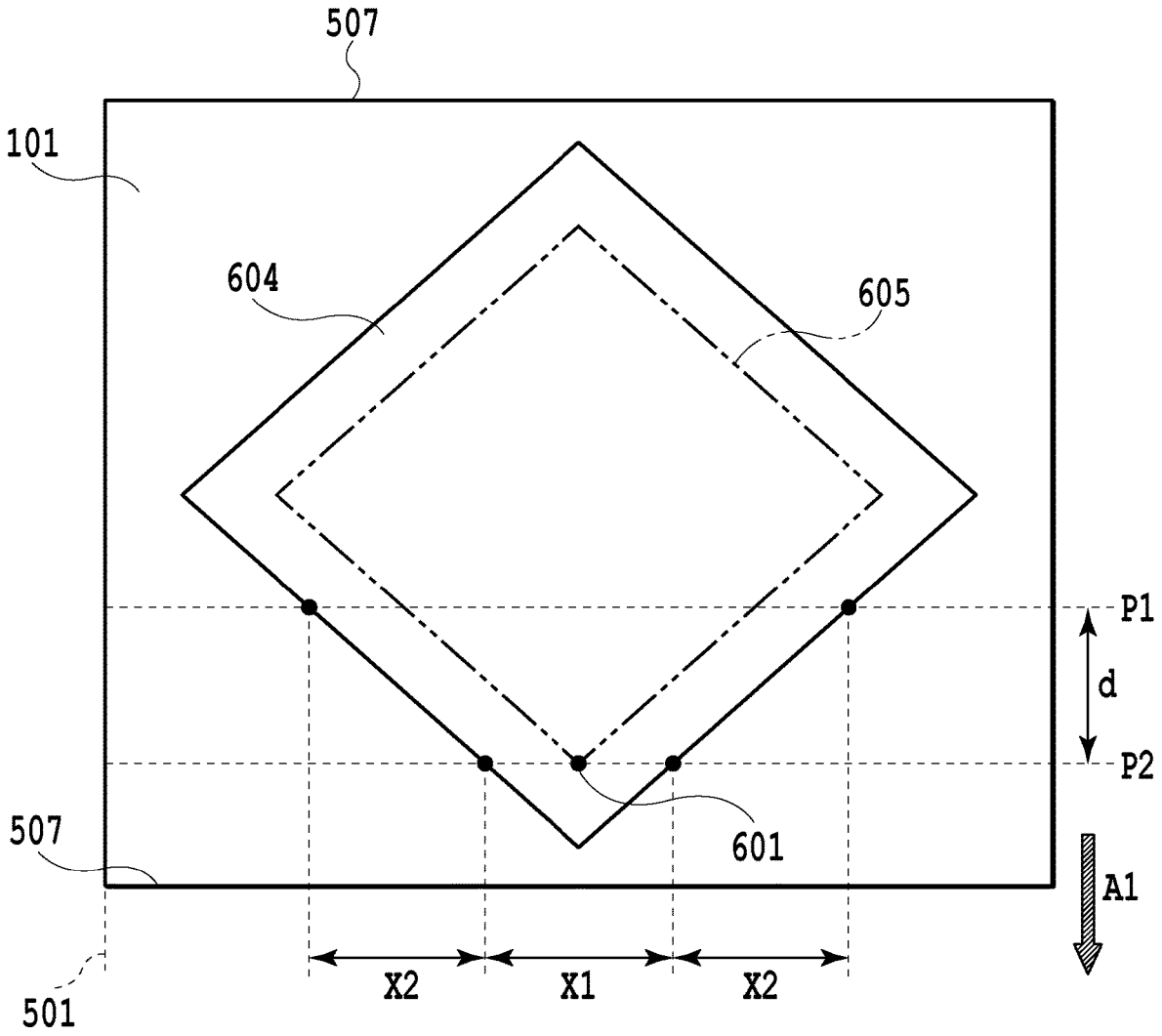
FIG. 15 is a diagram illustrating a relation between a position of a print image with respect to a label, a position of a sensor, and a printing start position.

FIG. 15 is a diagram illustrating a position relation of a label 604 which is the print region, an image print region 605, a printing start position by the print head 105, and a label detection position by the sensor. In the present embodiment, an explanation in which a diamond image 605 is printed on a diamond label 604 attached to the base 101 will be described.

P1 shown in FIG. 15 is a line indicating a position at which a label 604 can be detected by the sensor 200, and P2 is a line at which printing by the print head 105 is started. In the present embodiment, P2 is the printing start position of the print head 105K since the print head 105K is located at the most upstream position in the conveyance direction of the print medium. Further, d shown in FIG. 15 indicates a distance from P1 to P2, that is, a distance of the T-K gap described above.

In order to detect the label before printing of a leading end portion 601 of the image region 605 is started, it is preferable that it be possible to detect the label 604 on the line of P1 at a stage before the image leading end portion 601 reaches the printing start position P2. To this end, it is preferable that the end portion of the label 604 on the conveyance direction (A1 direction) side be on the conveyance direction A1 side further than the image leading end portion 601. This is the range indicated by X1 shown in FIG. 15.

Alternatively, even when the end portion of the label 604 on the conveyance direction A1 side is on the upstream side further than the image leading end portion 601 in the direction of A1, it is preferable that a distance from the image leading end portion 601 to the end portion of the label 604 on the conveyance direction A1 side be less than d. This becomes the range indicated by X2 shown in FIG. 15.

In other words, in the host PC 320, a region corresponding to X1 or X2 is detected from the shape of the label 604 and the shape of the image print region 605. Then, CPU 301 moves the light emitting unit 110 and the light receiving unit 111 of the sensor 200 to any position in the region based on the information on the respective positions of X 1 and X 2 transmitted from the host PC 320, and thus it is possible to correctly print the image of the image print region 605 on the basis of the detection result of the label 604.

In detecting X1 and X2, a value corresponding to a time required until printing is started by the print head 105 after the label 604 is detected may be added to the distance d from P1 to P2. Accordingly, X1 and X2 can be set in accordance with the operation of the printing apparatus.

In any of the first to fourth embodiments, the light from the light emitting elements 201 and 131 of the light emitting unit is used as the inspection signal. In other words, the transmissive optical sensor or the reflective optical sensor is used as the sensor. However, the inspection signal is not limited to the light as long as it is possible to reflect the difference (transmittance, reflectance, or a dielectric constant) in property between the materials of the print medium (the base and the label) and detect the level change of the detection signal obtained in accordance with the inspection signal. In other words, it is preferable that the sensor be able to detect the leading end portion position in the conveyance direction on the basis of the difference in the physical properties between the print medium and the print region. For example, a sound wave or an electromagnetic wave can be used. A sensor that detects a difference in height between the base and the label of several tens to several hundreds of micrometers using a light interferometer may be used.

In at least some process of specifying the leading end portion position of the label in the sensor, it is also possible to scan the inspection signal and output the image data to the print medium without actually moving the sensor 200 in the direction intersecting the conveyance direction. In other words, an implementation method of scanning a point at which the inspection signal is given onto the print medium and a point at which the detection signal occurs through the inspection signal can be also used. Further, the method of moving the sensor 200 as in the first to fourth embodiments may be combined with the method of scanning the inspection signal.

Further, the example in which the print medium of the target in the printing apparatus of the present invention includes the base and the label formed on the base as illustrated FIGS. 14A to 14C has been described. However, the sheet is not limited to the label sheet as long as it is possible to reflect the difference in the property between the base and the print region of the print medium and detect the level change of the detection signal obtained in accordance with the inspection signal. For example, a print region having different transmittance or different reflectance may be integrally formed on a transparent or translucent base material. Further, the print region (label) need not be a form in which it can be peeled off and attached as described above with reference to FIGS. 14A to 14C. For example, a print region (label) with different reflectance or different transmittance (for example, different color) may be integrally formed on the base or within the base and be a form in which there is a cut or a perforation which is separable around the print region, and the label is separated by punching.

As described above in detail, the printing apparatus of the present invention includes the specific sensor of the present invention and thus can support printing on print mediums of all shapes and detect the leading end portion of the print medium with high degree of accuracy. The detection of the leading end portion of the print medium can be implemented at a lower cost than in the related art.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-119595, filed Jun. 19, 2017, and No. 2018-106414, filed Jun. 1, 2018, which are hereby incorporated by reference herein in their entirety.

What is claimed is:

1. A printing apparatus that prints an image on a print medium, which includes a sheet serving as a base and a label supported on the sheet, said apparatus comprising:

an acquiring unit configured to acquire information on a shape of the label;

a printing unit configured to perform printing on the label;

a conveying unit configured to convey the print medium in a predetermined conveyance direction;

a detecting unit configured to detect the label;

a moving unit configured to cause the detecting unit to be movable in a direction intersecting width direction of the sheet, wherein the width direction crosses the conveyance direction; and a control unit configured to, in a case where the label has a shape including a portion protruding towards a downstream side in the conveyance direction, cause the moving unit to move the detecting unit to a region corresponding to a most protruding position of the label on the downstream side in the conveyance direction and to stop the detecting unit in the region on the basis of information acquired by the acquiring unit, and cause the printing unit to start the printing on the label on the basis of a detection result of the detecting unit that is located in the region.

2. The printing apparatus according to claim 1, wherein the detecting unit is movable in a width direction of the print medium.

3. The printing apparatus according to claim 1, further comprising, a regulating unit configured to come into contact with one end of the print medium in the width direction to regulate movement of the print medium when the print medium is conveyed.

4. The printing apparatus according to claim 1, wherein the detecting unit includes a transmissive optical sensor.

5. The printing apparatus according to claim 4, wherein the detecting unit includes:

a light emitting unit that is movable in the width direction; and a light receiving unit that is moveable in the width direction independently of the light emitting unit.

6. The printing apparatus according to claim 5, wherein the detecting unit is a single unit including the light emitting unit and the light receiving unit.

7. The printing apparatus according to claim 1, wherein the detecting unit includes a transmissive optical sensor or a reflective optical sensor.

8. A printing apparatus that prints an image on a print medium, which includes a sheet serving as a base and a label supported on the sheet, said apparatus comprising:

an acquiring unit configured to acquire an image to be printed and information on a shape of the print medium;

a printing unit configured to perform printing on the print medium;

a conveying unit configured to convey the print medium in a predetermined conveyance direction;

a detecting unit configured to detect the print medium, a moving unit configured to cause the detecting unit to be movable in a direction intersecting the conveyance direction; and a control unit configured to, in a case where the label has a shape including a portion protruding towards a downstream side in the conveyance direction, cause the moving unit to move the detecting unit to a region in which the print medium is located on a more downstream side in the conveyance direction than an end portion of the image on the downstream side in the conveyance direction and to stop the detecting unit in the region on the basis of information acquired by the acquiring unit, and the control unit is also configured to cause the printing unit to start the printing on the basis of a detection result of the detecting unit that is located in the region.

9. A printing apparatus that prints an image on a print medium, which includes a sheet serving as a base and a label supported on the sheet, said apparatus comprising:

an acquiring unit configured to acquire information on a shape of the label;

a printing unit configured to perform printing on the label;

a conveying unit configured to convey the print medium in a predetermined conveyance direction;

a detecting unit configured to detect the label;

a moving unit configured to cause the detecting unit to be movable in a direction intersecting the conveyance direction; and a control unit configured to, in a case where the label has a shape including a portion protruding towards a downstream side in the conveyance direction, cause the moving unit to move the detecting unit to a predetermined position and to stop the detecting unit in the predetermined position based on the information acquired by the acquisition unit and cause the printing unit to start the printing on the label on the basis of a detection result by the detecting unit that is located in the predetermined position.

10. A printing method of printing an image on a print medium, which includes a sheet serving as a base and a label supported on the sheet, said method comprising:

an acquisition step of acquiring information on a shape of the label;

a movement step of moving a detecting unit that detects the label to a region corresponding to a most protruding position of the label towards a downstream side in the conveyance direction and of stopping the detecting unit in the region on the basis of information acquired in the acquisition step in a case where the label has a shape including a portion protruding towards the downstream side in the conveyance direction;

a conveyance step of conveying the print medium in the predetermined conveyance direction;

a detection step of detecting the label in the region; and a printing step of starting printing on the label on the basis of a detection result of the detecting step.

11. A printing apparatus that prints an image on a print medium, which includes a sheet serving as a base and a label supported on the sheet, said apparatus comprising:

an acquiring unit configured to acquire an image to be printed and information on a shape of the print medium;

a printing unit configured to perform printing on the print medium;

a conveying unit configured to convey the print medium in a predetermined conveyance direction;

a detecting unit configured to detect the print medium;

a moving unit configured to cause the detecting unit to be movable in a direction intersecting the conveyance direction; and a control unit configured to, in a case where the label has a shape including a portion protruding towards a downstream side in the conveyance direction, cause the moving unit to move the detecting unit to a region and to stop the detecting unit in the region on the basis of information acquired by the acquiring unit, and the control unit is also configured to cause the printing unit to start the printing on the basis of a detection result of the detection unit that is located in the region, wherein, in the region, a first distance from an end portion of the image on the downstream side in the conveyance direction to an end portion of the label on the downstream side in the conveyance direction, with the end portion of the label being positioned on a more downstream side in the conveyance direction than the end portion of the image, is smaller than a second distance from a detection position of the detecting unit to a printing start position of the printing unit, with the printing start position being positioned on a more downstream side in the conveyance direction than the detection position.

* * * * *